US007458215B2

(12) United States Patent
Yaguchi et al.

(10) Patent No.: US 7,458,215 B2
(45) Date of Patent: Dec. 2, 2008

(54) STIRLING ENGINE AND HYBRID SYSTEM WITH THE SAME

(75) Inventors: Hiroshi Yaguchi, Susono (JP); Daisaku Sawada, Gotenba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 244 days.

(21) Appl. No.: 10/564,351

(22) PCT Filed: Sep. 24, 2004

(86) PCT No.: PCT/JP2004/013953

§ 371 (c)(1),
(2), (4) Date: Jan. 12, 2006

(87) PCT Pub. No.: WO2005/033592

PCT Pub. Date: Apr. 14, 2005

(65) Prior Publication Data

US 2006/0207249 A1 Sep. 21, 2006

(30) Foreign Application Priority Data

Oct. 1, 2003 (JP) ..... 2003-343416
Oct. 1, 2003 (JP) ..... 2003-343420

(51) Int. Cl.
*F02G 3/00* (2006.01)

(52) U.S. Cl. ..... 60/616; 60/620; 60/517

(58) Field of Classification Search ..... 60/616, 60/620, 517–526

See application file for complete search history.

(56) References Cited

U.S. PATENT DOCUMENTS 3,845,624 A 11/1974 Roos
4,255,929 A 3/1981 McDougal (Continued)

FOREIGN PATENT DOCUMENTS

DE 41 37 756 A1 5/1993

(Continued)

OTHER PUBLICATIONS

Kubota; "Dynamics of Mechanism (Kiko Gaku)"; Fundamental Mechanical Engineering Treatise vol. 6; Mar. 18, 1988; pp. 162-164; with translation.

*Primary Examiner*—Hoang M Nguyen
(74) *Attorney, Agent, or Firm*—Oliff & Berridge, PLC

(57) ABSTRACT

The present invention provides a stirling engine, which is capable of reducing a frictional loss and eliminating possibility of deterioration of a heat exchanger due to lubricant oil applied to piston rings and the like. The stirling engine includes cylinders (22,32), pistons (21,31) reciprocating inside the cylinder while keeping an air-tight condition between the piston and the cylinder by means of a gas bearing (48), and an linear approximation mechanism (50) coupled directly or indirectly to the piston and disposed so that the piston may make approximately linear motion when the piston reciprocates inside the cylinder. The stirling engine has a piston engine which is in a ringless (i.e., without piston rings) and oilless (i.e., without lubricant oil) state so as to reduce the frictional loss and to prevent the deterioration of the heat exchanger by the lubricant oil. Since the linear approximation mechanism enables the piston to make approximately linear motion, side force on the piston is virtually eliminated. The stirling engine is effectively used with a gas bearing which has low pressure resistance to side force.

22 Claims, 27 Drawing Sheets

U.S. PATENT DOCUMENTS

| | | | | | |
|---|---|---|---|---|---|
| 4,546,663 | A | * | 10/1985 | Wood | 74/40 |
| 4,738,105 | A | * | 4/1988 | Ross et al. | 60/517 |
| 4,760,698 | A | | 8/1988 | Bartolini et al. | |
| 4,979,428 | A | * | 12/1990 | Nelson | 92/140 |
| 5,146,749 | A | * | 9/1992 | Wood et al. | 60/517 |
| 5,317,874 | A | | 6/1994 | Penswick et al. | |
| 5,417,066 | A | | 5/1995 | Kawano et al. | |
| 5,857,436 | A | | 1/1999 | Chen | |
| 6,543,229 | B2 | | 4/2003 | Johansson | |

FOREIGN PATENT DOCUMENTS

| | | |
|---|---|---|
| FR | 1.010.210 | 6/1952 |
| JP | A 58-192951 | 11/1983 |
| JP | A 4-311656 | 11/1992 |
| JP | A 5-256367 | 10/1993 |
| JP | A 8-93547 | 4/1996 |
| JP | A 2001-99003 | 4/2001 |
| JP | A 2002-89985 | 3/2002 |

* cited by examiner

Embodiment $$\overline{AM} \cdot \overline{QM} = \overline{BM}^2$$

| Stroke | 36 | [mm] |
|---|---|---|
| LINK RELATIVE (AC:PC ) | 3 | [--] |
| AB | 54 | [mm] |
| AM | 22 | [mm] |
| BM | 32 | [mm] |
| QM | 46.55 | [mm] |
| RB | 110 | [mm] |
| $\theta$ | 8.8 ~ -17.9 | [°] |
| $\phi$ | 0 ~ 2.2 | [°] |

STIRLING ENGINE AND HYBRID SYSTEM WITH THE SAME

TECHNICAL FIELD

The present invention relates to a stirling engine and a hybrid system with the same and in particular, relates to a stirling engine, of which a frictional loss may be reduced, and a hybrid system with the same.

BACKGROUND ART

A stirling engine has an advantage in that higher heat efficiency is expected. Moreover, the stirling engine, which is an external combustion engine, of which working fluid is heated externally, has another advantage in that it contributes to energy saving because it may exploit a wide variety of alternative energy of low temperature-gradient such as solar, geothermal, and exhaust heats, regardless of heat source.

Conventionally, the stirling engine as shown in FIG. 41 has been known. A high-temperature cylinder 102 and a low-temperature cylinder 103 are provided in the form of protrusions in an engine room 101. A heater 104 is connected to the upper side of the high-temperature cylinder 102 and a cooler 105 is connected to the low-temperature cylinder 103. The heater 104 and the cooler 105 are connected to one another via a regenerator 106. An expanding piston 107 and a compressing piston 108 are reciprocally disposed at the high-temperature cylinder 102 and the low-temperature cylinder 103, respectively. The pistons 107, 108 are connected to a crankshaft 111 by means of connecting rods 109, 110, respectively to reciprocate at a predetermined phase difference, for example, at an angle of 90° relative to one another.

A working fluid, for example, He, $H_2$, or $N_2$, is filled in the high-temperature cylinder 102, the low-temperature cylinder 103, the heater 104, the cooler 105, the regenerator 106, and a plumping system connecting them. An expansion space on the upper side of the high-temperature cylinder 102 and a compression space on the upper side of the low-temperature cylinder 103 are sealed by means of piston rings 112, 113 attached to the pistons 107, 108, respectively.

The working fluid, when being heated by a heat source (not shown) at the heater 104, expands and presses down the expanding piston 107, whereby the crankshaft rotates. On the other hand, when the expanding piston switches its movement to a rising stroke, the working fluid is carried into the regenerator 106 through the heater 104. At the regenerator 106, the working fluid transfers its heat to a filled thermal storage medium, flows out to the cooler 105 for cooling, and is compressed as the compressing piston 108 rises. The working fluid compressed in this way flows back into the heater 104 while drawing heat from the thermal storage medium in the regenerator 106 to produce an increase in its temperature, and flows into the heater 104, where it is heated by the heat source for expansion again.

Japanese Patent Application Laid-Open No. H4-311656 (Patent Document 1) discloses a stirling engine wherein a piston pin is guided by means of a Watt Z-shaped linear approximation link mechanism.

Further, a technique, by which a gas bearing is inserted between a piston and a cylinder, is disclosed in Japanese Patent Application Laid-Open No. 2002-89985 (Patent Document 2). In the Patent Document 2, a sterling engine is described, which has been designed so that a gas, which is supplied toward the piston through orifices formed on the gas bearing pad of a cylinder, provides the piston with buoyancy to ensure a non-contact state or a light load applied between the piston and the cylinder, producing no or a less frictional force.

Patent Document 1: Japanese Patent Application Laid-Open No. H04-311656

Patent Document 2: Japanese Patent Application Laid-Open No. 2002-89985

Patent Document 3: Japanese Patent Application Laid-Open No. H05-256367

DISCLOSURE OF INVENTION

Problem to be Solved by the Invention

The stirling engine is disadvantageous in that the internal friction is large.

To ensure the output from the stirling engine, the working fluid in the cylinder must be highly pressurized. Then, a sealing element must be strengthened. However, the strengthening of the sealing element, especially the strengthening with piston rings, incurs a further increase in friction. An increase in friction requires a heat source capable of generating a larger amount of heat and the further pressurization of the working fluid to reserve the sufficient output. Further, a lubricant leaked from the piston ring invades into a heat exchanger, causing it to deteriorate.

Various types of frictional losses may occur in the stirling engine, among which the largest is found between the piston and the cylinder. Frictional loss between the piston and the cylinder is not described in the aforementioned Patent Document 1 and a measure for reducing the friction to improve its performance is insufficient. In particular, if the stirling engine is used in the environment where it is difficult to reserve ample heat from the heat source, for example, when a gas exhausted from the internal combustion engine mounted on a vehicle is used as a heat source, the friction must be minimized as far as possible.

A gas bearing has low pressure-resistance to side force. The gas bearing disclosed in the Patent Document 2, in particular, which supports an object by means of the gas pressure distributed across the minute clearance left between it and the object instead of the gas forcibly supplied, has lower pressure-resistance to side force. Thus, when the gas bearing is used to support the piston, a measure must be taken to prevent the side force from being exerted on the piston. The Patent Document 2, however, does not disclose any measure for side force prevention of the piston. Particularly when the above mentioned gas bearing utilizing the gas pressure distribution is employed, a measure must be taken to prevent undesirable effect of the side force on the piston.

A primary object of the present invention is to provide a stirling engine, wherein a frictional loss can be reduced, and a hybrid system with the same.

Another object of the present invention is to provide a stirling engine, wherein the frictional loss can be reduced and a heat exchanger may not deteriorate by a lubricant applied on an element such as the piston rings, and a hybrid system with the same.

Still another object of the present invention is to provide a piston engine and a stirling engine, wherein the frictional loss can be reduced and the housings can be downsized, and a hybrid system with the same.

Means for Solving Problem

The stirling engine of the present invention includes a cylinder; a piston reciprocating inside the cylinder while keeping an air-tight condition between the piston and the cylinder by means of a gas bearing; and a linear approximation mechanism coupled directly or indirectly to the piston to make an approximately linear motion when the piston reciprocates inside the cylinder.

The stirling engine of the present invention further includes a crankshaft rotating around a driving shaft; an extension extending downward from the piston; and a connecting rod coupling the extension and the crankshaft, wherein the linear approximation mechanism is coupled to a coupling element between the extension and the connecting rod to control movement of the coupling element so that the coupling element makes an approximately linear motion along an axial centerline of the cylinder.

The stirling engine of the present invention is further characterized in that the piston and the extension are rotatably coupled to one another.

The stirling engine of the present invention is further characterized in that the linear approximation mechanism is configured so that a first deviation of the coupling element from the axial centerline of the cylinder at an upper dead point of the piston is smaller than a second deviation of the coupling element from the axial centerline of the cylinder at a lower dead point of the piston.

The stirling engine of the present invention is further characterized in that the linear approximation mechanism is a grasshopper mechanism.

The stirling engine of the present invention is characterized in that the linear approximation mechanism is a grasshopper mechanism. The grasshopper mechanism includes first and second lateral links and a longitudinal link. A first end of the first lateral link is rotatably coupled to a coupling element between the extension and the connecting rod. A second end of the first lateral link is rotatably coupled to a first end of the longitudinal link. A second end of the longitudinal link is rotatably fixed to a predetermined position of the stirling engine. A first end of the second lateral link is rotatably coupled to the first lateral link at a predetermined position in the middle of the first lateral link. A second end of the second lateral link is rotatably fixed to the stirling engine at a predetermined position.

The stirling engine of the present invention is further characterized in that in the grasshopper mechanism, the first end of the second lateral link has a two-forked structure having two folk ends, and the first end of the first lateral link is configured to pass between the fork ends.

The stirling engine of the present invention is further characterized in that in the grasshopper mechanism, the first end of the first lateral link and the coupling element between the extension and the connecting rod are coupled by means of a single piston pin.

The stirling engine of the present invention is further characterized in that in the grasshopper mechanism, among the first end of the first lateral link, an end of the extension at the coupling element between the extension and the connecting rod, and an end of the connecting rod, two ends have a two-forked structure having two fork ends, and the end of the remaining one of the three ends is disposed between the two fork ends of two other ends.

The stirling engine of the present invention is further characterized in that it further includes a crankshaft which rotates; and a connecting rod coupling the crankshaft and the piston, wherein the linear approximation mechanism has a first lateral arm, a second lateral arm, and a linearly moving guide. The first lateral arm is disposed so that the first lateral arm intersects with the connecting rod and is roratable around a supporting point placed between the piston and the crankshaft, at a position offset relative to an axial centerline of the cylinder. The second lateral arm has first and second ends, wherein at the first end, a first locomotive coupling point, which linearly reciprocates is placed. At the second end, a second locomotive coupling point is coupled to the piston. Between the first and second locomotive coupling points, a third locomotive coupling point is placed. At the third locomotive coupling point, an end of the first lateral arm opposite to the supporting point is rotatably coupled. The linearly moving guide supports the first locomotive coupling point and guides the first locomotive coupling point as to make a linear motion.

The stirling engine of the present invention is further characterized in that the linearly moving guide includes a cylindrical guide and a slider piston that slides inside the cylindrical guide, and the linearly moving guide includes a function of serving as a compressor that compresses the gas inside the cylindrical guide by means of the reciprocating motion by the slider piston inside the cylindrical guide.

The stirling engine of the present invention is further characterized in that it includes a plurality of the pistons, and a plurality of the linear approximation mechanisms disposed corresponding to the plurality of the pistons, respectively, wherein a plurality of the compressors are provided corresponding to the plurality of the linear approximation mechanisms, respectively, and the compressors are connected in line so that the compressors increase the pressure applied to the gas in steps.

The stirling engine of the present invention is further characterized in that a discharge from the subsequent compressor is smaller than a discharge from the previous compressor.

The stirling engine of the present invention is further characterized in that it includes a housing disposed with at least the crankshaft enclosed inside, wherein the inside of the housing is pressurized by means of the compressor.

A hybrid system of the present invention is characterized in that it includes the stirling engine of the present invention and an internal combustion engine for a vehicle. The stirling engine is mounted on the vehicle, and a heater of the stirling engine draws heat from an exhaust system of the internal combustion engine.

A piston engine of the present invention is characterized in that it includes a cylinder, a piston reciprocating inside the cylinder while keeping an air-tight condition between the cylinder and the piston by means of a gas bearing, a rotatable crankshaft, a connecting rod coupling the crankshaft and the piston, and a linear approximation mechanism coupled directly or indirectly to the piston and disposed so that the piston makes approximately linear motion when the piston reciprocates inside the cylinder.

A piston engine according to the present invention is further characterized in that it includes a cylinder; a piston reciprocating inside the cylinder while keeping an air-tight condition between the piston and the cylinder by means of a gas bearing; a rotatable crankshaft; a connecting rod coupling the crankshaft and the piston, a first lateral arm; a second lateral arm; and a linearly moving guide. The first lateral arm is disposed so that the first lateral arm intersects with the connecting rod and makes rotational motion around the supporting point placed between the piston and the crankshaft, at a position offset relative to an axial centerline of the cylinder. The second lateral arm has first and second ends. At the first end, the first locomotive coupling point that linearly reciprocates is placed. At the second end, the second locomotive coupling point is coupled to the piston. Between the first locomotive coupling point and the second locomotive coupling point, the third locomotive coupling point is placed. At the third locomotive coupling point, an end of the first lateral arm opposite to the supporting point is rotatably coupled. The linearly moving guide supports the first locomotive coupling point and guides the first locomotive coupling point so that the first locomotive coupling point may make linear motion.

A piston engine of the present invention is characterized in that it is a stirling engine, and working fluid fed from the heat exchanger having a heater, a regenerator, and a cooler is introduced into the cylinder to drive the piston.

The piston engine of the present invention is characterized in that at least the heater of the heat exchanger is disposed on an exhaust pathway of the internal combustion engine to recover heat exhausted from the internal combustion engine.

The piston engine of the present invention is characterized in that the linearly moving guide has a cylindrical guide and a slider piston sliding inside the cylindrical guide. The lineraly moving guide also has a function as a compressor, which compresses a gas inside the cylindrical guide by means of reciprocating motion by the slider piston inside the cylindrical guide.

Effect of the Invention

The stirling engine of the present invention can reduce frictional loss thereby operating even under the conditions of a low-temperature heat source and low temperature gradient and increasing its output.

EXPLANATIONS OF LETTERS OR NUMERALS

Figure 1:
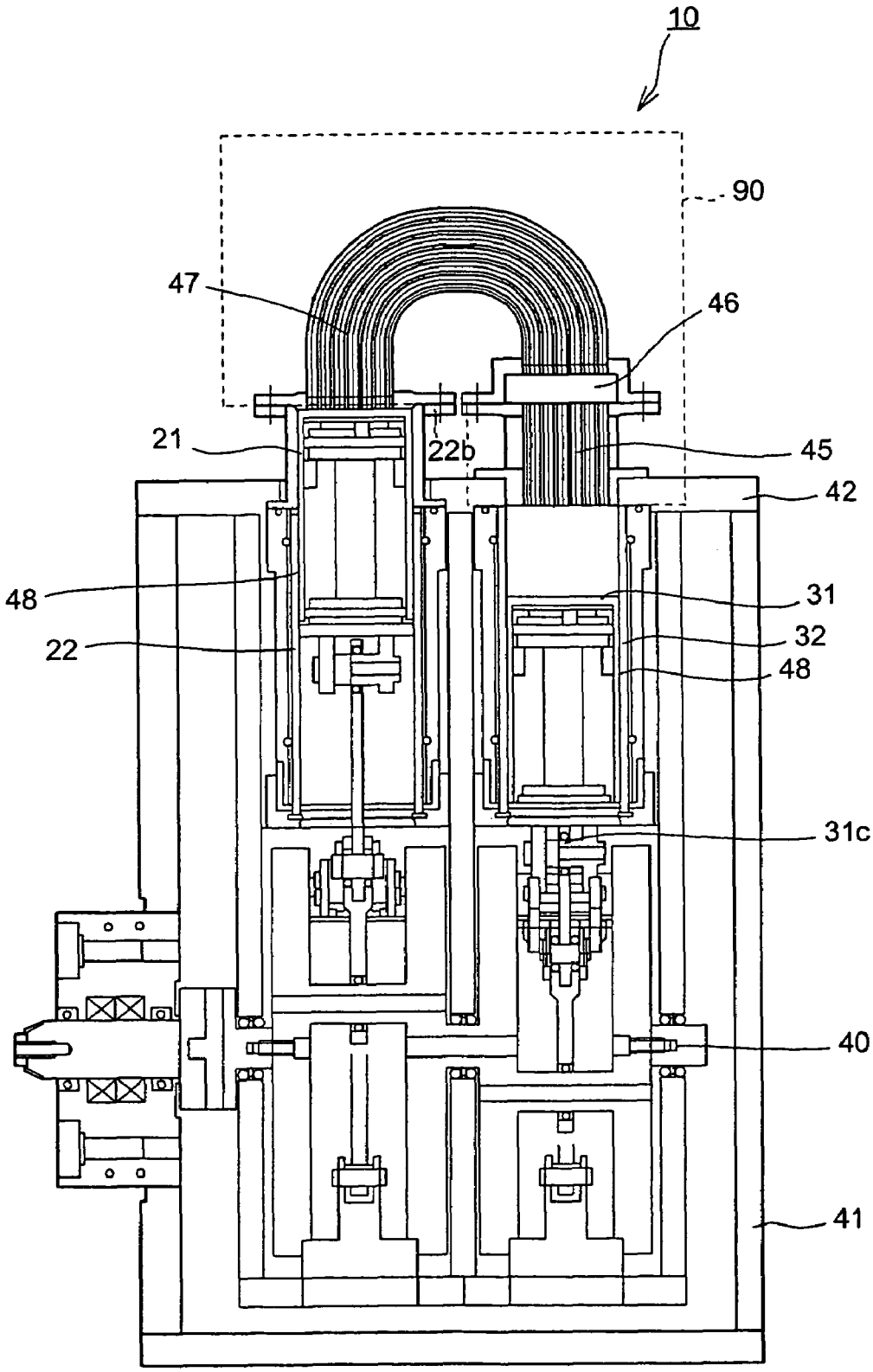
FIG. 1 is an elevation view showing a stirling engine according to embodiment 1 of the present invention.

10 stirling engine
21 expanding piston
22 high-temperature cylinder
31 compressing piston
32 low-temperature cylinder
45 cooler
46 regenerator
47 heater
48 gas bearing
50 linear approximation mechanism
60 piston pin
62 crank pin
64 piston support
65 connecting rod
67 pin
90 heat exchanger
100 exhaust plumbing
301 piston
302 cylinder
303 piston coupling member
304 crankshaft
305 connecting rod
310 linear approximation mechanism
311 first lateral arm
312 second lateral arm
320, 320$_1$, 320$_2$, 321, 322 linearly moving guide
320*g*, 320$_1$g, 320$_2$g, 321*g* guide
325, 325' slider piston
326 trank roller
330, 330$_1$, 330$_2$ compressor
400 stirling engine
418 crankcase
420 internal combustion engine
422 exhaust pathway
A first locomotive coupling point
B second locomotive coupling point
M third locomotive coupling point
Q supporting point

BEST MODES FOR CARRYING OUT THE INVENTION

Now, embodiments of a stirling engine of the present invention are described in detail below in reference to the accompanying drawings.

Embodiment 1

Figure 3:
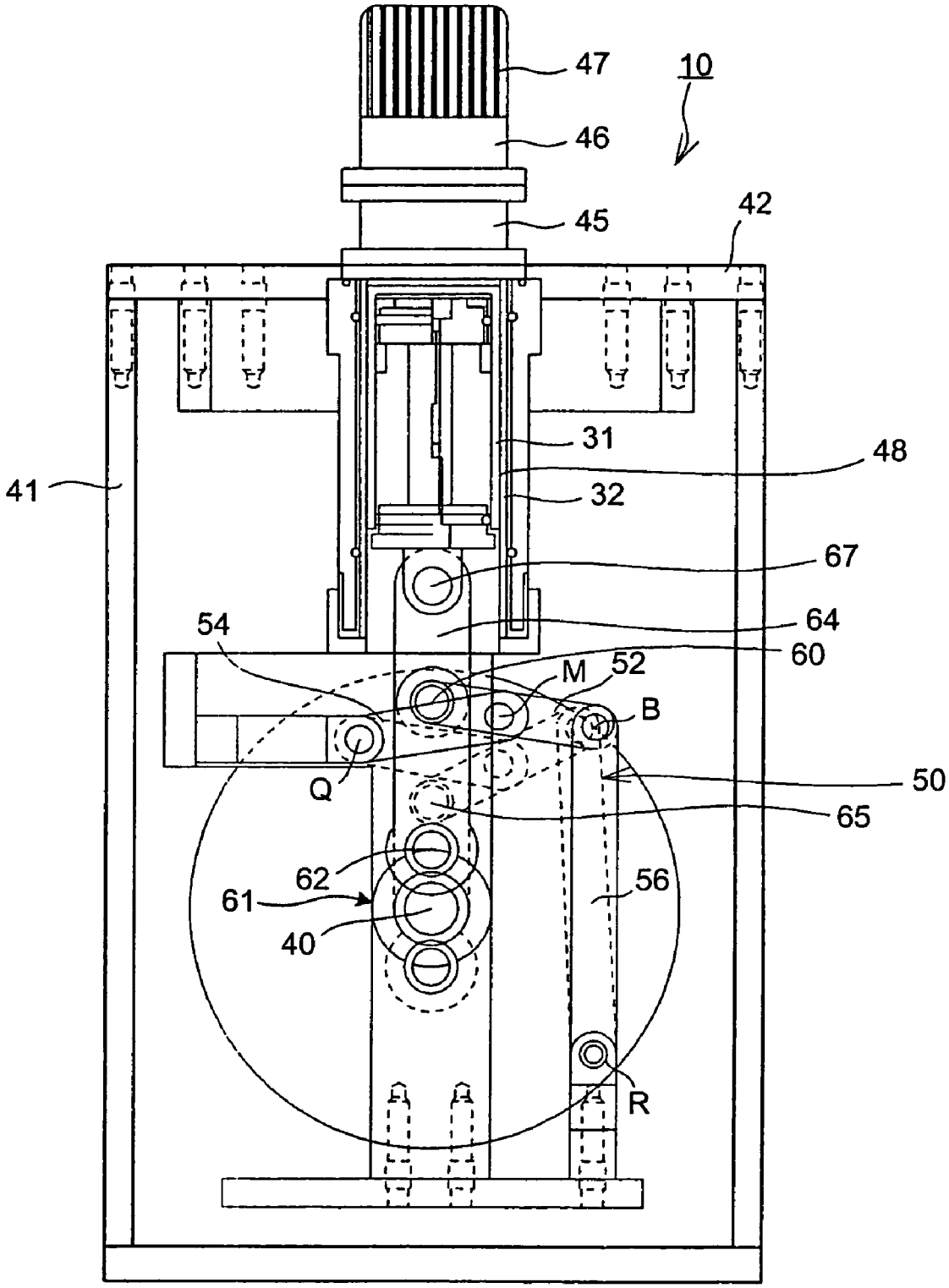
FIG. 3 is a side view showing the stirling engine according to embodiment 1 of the present invention.

FIG. 1 is an elevation view showing a stirling engine according to embodiment 1. FIG. 3 is a side view showing the stirling engine according to embodiment 1. As shown in FIGS. 1 and 3, the stirling engine 10 according to embodiment 1 is an α-type (dual-piston type) stirling engine having two power pistons. For a piston 31 of the low-temperature power piston, a phase difference has been established relative to a piston 21 of the high-temperature power piston. This enables the former to stroke later than the latter in an amount equivalent to a crank angle of approximately 90°.

A working fluid heated by a heater 47 flows into a space (expansion space) above a cylinder (hereinafter, referred to as high-temperature cylinder) 22 of the high-temperature power piton. The working fluid cooled by a cooler 45 flows into a space (compression space) above a cylinder (hereinafter, referred to as low-temperature cylinder) 32 of the low-temperature power piton. A regenerator 46 stores heat while the working fluid flows into or out from the expansion and compression spaces. Specifically, the regenerator 46 draws heat from the working fluid when the working fluid flows out from the expansion space into the compression space, whereas the regenerator 46 passes the stored heat to the working fluid when the fluid flows out from the compression space into the expansion space.

As two pistons 21, 31 reciprocate, the flow of the working fluid also reciprocates, whereby not only the ratio of the working fluid between the expansion space above the high-temperature cylinder 22 and the compression space above the low-temperature cylinder 32 but also the total internal volume of the working fluid change, producing a difference in pressure. When the applied pressures when two pistons 21, 31 stay at the same levels are compared, it can be known that the pressure applied by the expanding piston 21 when it falls is significantly higher than that applied when it rises. On the contrary, in the compressing piston 31, the pressure applied when it falls is lower than that applied when it rises. For this reason, the expanding piston 21 performs a large amount of positive work (expansion work) externally, while the compressing piston 31 needs to receive an external work (compression work). Some of the expansion work is used in the compression work and the rest is drawn out as an output by means of an output shaft 40.

Each of the high-temperature cylinder 22 and the low-temperature cylinder 32, which has a cylindrical shape, is disposed at an upright position in a crankcase 41 formed into a rectangular box shape. The high-temperature cylinder 22 and the low-temperature cylinder 32 are fixed to a top 42 of the crankcase 41. The low-temperature cylinder 32 is completely accommodated inside the crankcase 41. A part of the high-temperature cylinder 22 is accommodated in the crankcase 41 and the rest protrudes out from the crankcase 41 into outside.

On the upper side of the low-temperature cylinder 32, the cooler 45 is disposed, on which, the regenerator 46 sits with one end of a heater 47 connected thereon. Another end of the heater 47 is connected to the top of the high-temperature cylinder 22. Cooling water is used in the cooler 45.

When the average pressure of the working fluid is higher, a differential pressure increases accordingly at the same temperature difference generated by the cooler 45 and the heater 47, whereby a higher output can be obtained. Therefore, the working fluid inside the high-temperature cylinder 22 and the low-temperature cylinder 32 is kept under a high-pressure condition. According to embodiment 1, the inside of the crankcase 41 is entirely kept under a high-pressure condition. In other words, the crankcase 41 serves as a high-pressure container.

The pistons 21, 31 have a cylindrical shape. Between the outer surfaces of the pistons 21, 31 and the inner surfaces of the cylinders 22, 32, several tens μm of minute clearances are formed, respectively, wherein the working fluid (gas) for the stirling engine is filled in the clearances. As mentioned later, the pistons 21, 31 are supported by the cylinders 22, 32 in a contactless state by means of an air bearing 48. Hence, no piston rings are disposed around the pistons 21, 31 and no lubricant oil, which is usually used with the piston rings, is used neither. In stead, immovable lubricant agent is applied to the inner surfaces of the cylinders 22, 32. Although the air bearing 48 has intrinsically very low sliding resistance to the working fluid, the applied lubricant agent serves to further reduce the sliding resistance. As aforementioned, the air bearing 48 keeps the air-tight condition in both of the expansion and compression spaces by means of the working fluid, wherein the clearances are successfully sealed without the use of rings and lubricant oil.

Figure 2:
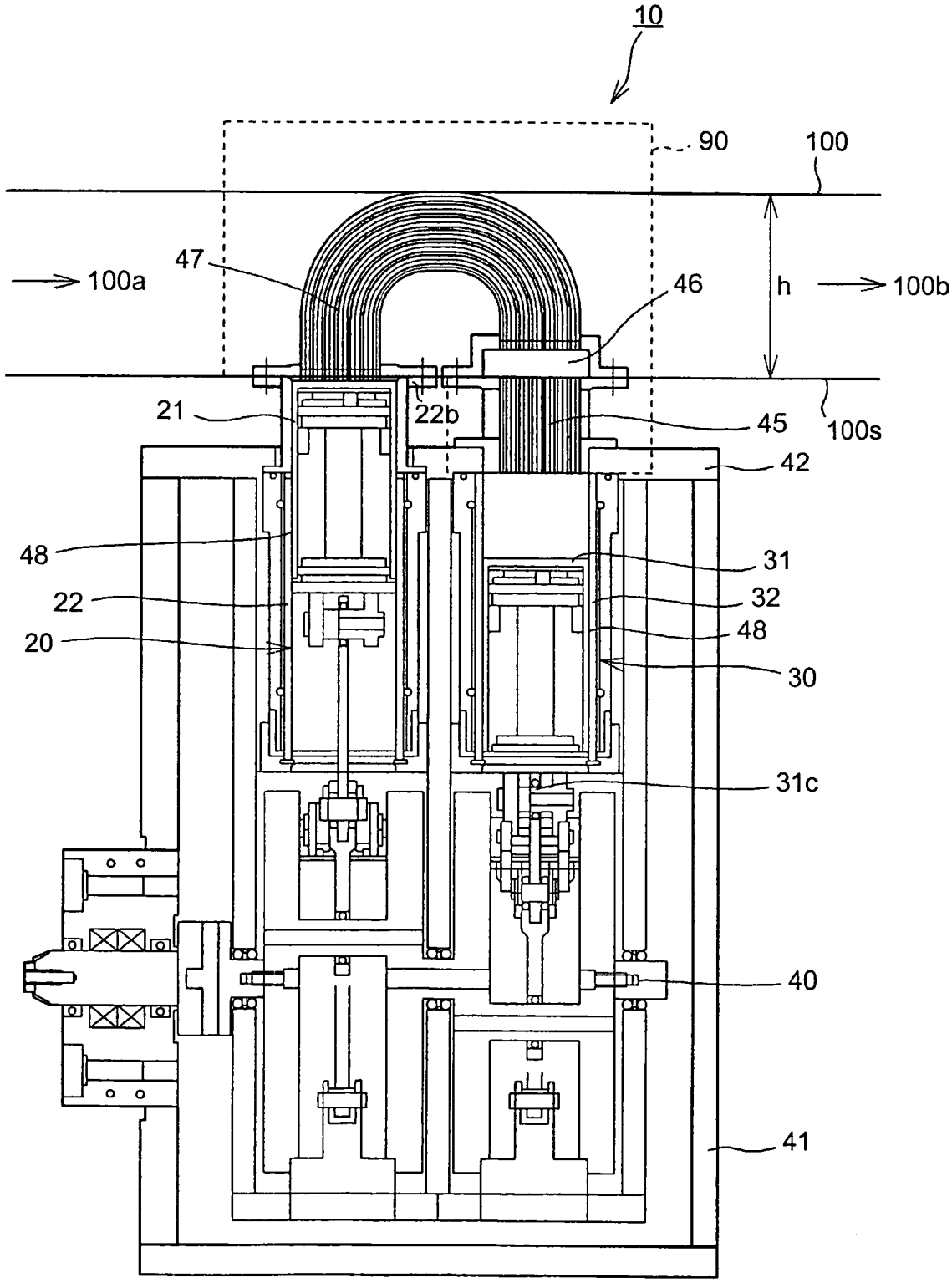
FIG. 2 is an elevation view showing the stirling engine according to embodiment 1 of the present invention, which is disposed on an exhaust plumbing.

The stirling engine 10 of embodiment 1 makes up a hybrid system together with a gasoline engine (internal combustion engine) in a vehicle. The stirling engine 10 uses gas exhausted from the gasoline engine as its heat source. As shown in FIG. 2, the heater 47 of the stirling engine 10 is disposed inside an exhaust plumbing 100 of the gasoline engine mounted on the vehicle. When heat energy drawn from the exhaust gas heats up the working fluid, the stirling engine initiates a stroking operation. Note that the heater 47 of the stirling engine 10 may be disposed at any point of the exhaust system of the internal combustion engine of the vehicle and not necessarily at the position on the exhaust plumbing.

According to embodiment 1, the stirling engine 10 is disposed in a limited space inside the vehicle as can be seen from its configuration where the heater 47 is accommodated in the exhaust plumbing 100. Hence, when employed devices are smaller, the possibility in arrangement expands. Therefore, the stirling engine 10 uses the configuration, where two cylinders 22, 23 are arranged in line side by side and not arranged in a V shape.

The heater 47 is disposed inside the exhaust plumbing 100 so that a high-temperature cylinder 22 side of the heater 47 may be positioned on an upstream side (i.e., at a position close to the gasoline engine) 100*a*, into which a relatively high-temperature exhaust gas flows, whereas a low-temperature cylinder 32 side of the heater 47 may be positioned on an downstream side (i.e., at a position far from the gasoline engine), into which a relatively low-temperature exhaust gas flows.

As aforementioned, the heat source for the stirling engine 10 is the gas exhausted from the gasoline engine mounted on the vehicle but not one developed exclusively for the stirling engine 10. Hence, obtainable heat quantity is not particularly high and the stirling engine 10 needs to run at a heat quantity of exhaust gas, i.e., approximately 800° C. According to embodiment 1, to achieve such operation, internal friction inside the stirling engine 10 is minimized as far as possible.

According to embodiment 1, to avoid a frictional loss due to the piston rings, which is the largest one among various types of frictional losses occurring in the stirling engine 10, air bearings 48 is disposed between cylinders 22, 32 and pistons 21, 31, respectively instead of piston rings.

The air bearing 48 having very small sliding resistance may significantly reduce the internal friction in the stirling engine. As aforementioned, though the air beating 48 is used, the air-tight condition may be kept between the cylinder 22, 32 and the pistons 21, 31. Then, the working fluid in the high-pressure condition may not leak out from the expansion and compression spaces even when the expansion/compression spaces expands/compresses, respectively.

The air bearing 48 uses the air pressure (distributed air pressure) generated at minute clearances formed between the cylinders 22, 32 and the pistons 21, 31 to float the pistons 21, 31 in the air. In the air bearing 48 according to embodiment 1, diametral clearances formed between the cylinders 22, 32 and the pistons 21, 31 have a size of several tens μm.

To float an object in the air, the air bearing may mechanically apply a strong air pressure to a specific portion (pressure gradient is produced), or a high-pressure air may be blown as mentioned later.

Moreover, since the use of the air bearing 48 eliminates the need for lubricant oil used for the piston rings, deterioration of a heat exchanger 90 (regenerator 46, heater 47, and the like) in the stirling engine 10 does not occur from the invasion of lubricant oil. Note that according to embodiment 1, among fluid bearings, any types of gas bearings excluding an oil bearing may be used if the problems are successfully solved concerning the sliding resistance and lubricant oil in the piston rings as aforementioned, thus an applicable bearing is not limited to the air bearing 48.

According to embodiment 1, a static air bearing may be used between the pistons 21, 31 and the cylinders 22, 32. The static air bearing floats an object (in embodiment 1, pistons 21, 31) in the air, generating a static pressure by jetting out the pressurized fluid. Alternatively, a dynamic air bearing may be used instead of the static air bearing.

When the air bearing 48 is used to reciprocate the pistons 21, 31 inside the cylinders 22, 32, the accuracy of the linear motion of the pistons 21, 31 must be within the range equivalent to the diametral clearance of the air bearing 48. In addition, since the air bearing 48 has small loading capacity, side force on the pistons 21, 31 needs to be substantially eliminated. In other words, it is required that higher accuracy of linear motion by the pistons 21, 31 relative to the lateral axes of the cylinders 22, 32 be ensured because the air bearing 48 has low resistance to pressure exerted in the diametrical directions of the cylinders 22, 32 (lateral and thrust directions).

The air bearing 48 used according to embodiment 1, in particular, which uses the air pressure at the minute clearance to float and support the pistons, has lower resistance to pressure exerted from the thrust direction than that of the type, which uses a jet of high-pressure air. Hence, higher accuracy of linear motion by the pistons is required.

According to embodiment 1, a grasshopper mechanism 50 (linear approximation link) is used in the piston-crank element as shown in FIG. 3 for the aforementioned reasons. The use of the grasshopper mechanism 50 has an advantage in that the whole system may be downsized because the same level of accuracy in linear motion can be achieved with a smaller mechanism than other linear approximation mechanism (for example, Watt mechanism). According to embodiment 1, in particular, the stirling engine 10 is disposed in the limited space inside the vehicle as known from its configuration where the heater 47 is accommodated in the exhaust plumbing 100 of the gasoline engine mounted on a vehicle. Hence, a smaller overall configuration of the apparatus can allow for more flexible arrangement of the stirling engine 10.

In addition, the grasshopper mechanism 50 is advantageous in terms of fuel consumption because the weight of the grasshopper mechanism necessary to achieve the same level of accuracy in linear motion is lighter than other mechanism. In addition, the grasshopper mechanism 50 having a relatively simple configuration is easy to design (manufacture and assemble).

Now, the grasshopper linear approximation mechanism 50 is described in detail below in reference to FIGS. 3 to 16.

Figure 4:
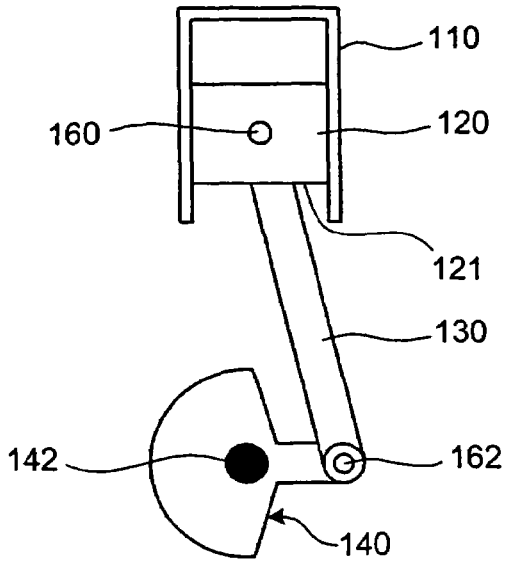
FIG.4 Conventional art
FIG. 4 is a schematic diagram showing a conventional piston-crank mechanism.
Figure 5:
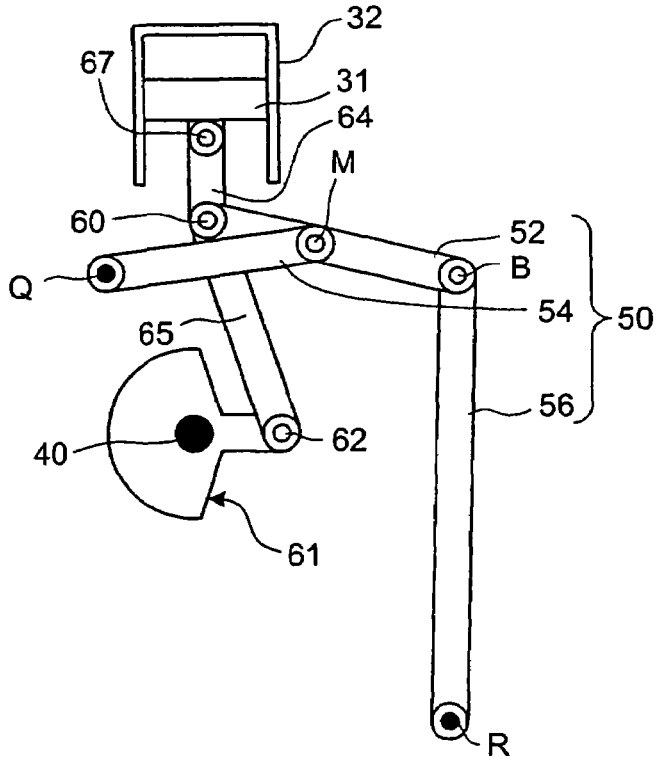
FIG. 5 is a schematic diagram showing a piston-crank mechanism applicable to the stirling engine according to embodiment 1 of the present invention.

A. Overview of a Piston-Crank Mechanism:

FIG. 4 is a schematic diagram showing a piston-crank mechanism of a conventional stirling engine. FIG. 5 is a schematic diagram showing the piston-crank mechanism of the stirling engine 10 according to embodiment 1. As shown in FIG. 4, the conventional mechanism has a cylinder 110, a piston 120, a connecting rod 130, and a crankshaft 140. The crankshaft 140 includes a crank journal, a crank arm, and a crank pin 162. The piston 120 and the connecting rod 130 are coupled to one another by means of a piston pin 160 disposed in the vicinity of the middle point of the piston 120. The connecting rod 130 and the crankshaft 140 are coupled to one another by means of the crank pin 162. As the piston 120 reciprocates up and down, the crankshaft 140 rotates around a shaft 142 (also referred to as an output shaft).

FIG. 5 shows an overall structure of the piston-crank mechanism of the stirling engine 10. According to embodiment 1, the piston-crank mechanism with the same configuration is used on both of the high-temperature power piston side and the low-temperature power piston side. Therefore, only the low-temperature power piston side is described below and the explanation of the high-temperature power piston side is omitted.

The piston-crank mechanism of the stirling engine 10 has the cylinder 32, the piston 31, the connecting rod 65, and the crankshaft 61, as well as the linear approximation mechanism 50. As aforementioned, the linear approximation mechanism 50 is a grasshopper linear approximation mechanism. The crankshaft 61 includes a crank journal, a crank arm, and a crank pin 62.

As shown in FIGS. 3 and 5, the piston 31 is connected to a piston support 64. The piston 31 and the piston support 64 are formed separately. The bottom of the piston 31 and the top of the piston support 64 are rotatably coupled to one another by means of a pin 67. The piston support 64 is coupled to each other at its bottom by means of a piston pin 60. The connecting rod 65 and the crankshaft 61 are coupled to one another by means of the crank pin 62. As the piston 31 reciprocates up and down, the crankshaft 61 rotates around the shaft 40 (also referred to as the output shaft).

The linear approximation mechanism 50 has two lateral links 52, 54 and one longitudinal link 56. One end of the first lateral link 52 is rotatably coupled to the bottom of the piston support 64 at the position of the piston pin 60. One end of the second lateral link 54 is rotatably coupled to the first lateral link 52 at a predetermined position in the middle of the first lateral link 52. The other end of the second lateral link 54 is rotatably fixed to the piston-crank mechanism at a predetermined position. One end of the longitudinal link 56 is rotatably coupled to the first lateral link 52 on the opposite side of the piston pin 60 of the first lateral link 52. The other end of the longitudinal link 56 is rotatably fixed to the piston-crank mechanism at a predetermined position.

In FIGS. 4 and 5, the coupling elements (output shaft 40 and the like) indicated by black dots rotate or rotationally move around the shafts, and are coupling points (hereinafter, simply referred to as supporting points) of which positions relative to the cylinder 32 remain unchanged. The coupling elements (for example, the piston pin 60) indicated by white dots rotate or rotationally move around the shafts, and are coupling points (hereinafter, simply referred to as locomotive coupling points) of which positions relative to the cylinder 32 change. The term "rotation" herein means that an object rotates by 360° or more, while "rotational motion" means that the object rotates by less than 360°.

Note that in FIGS. 4 and 5, elements other than the piston-crank mechanism and the cylinder 32 in the stirling engine 10 according to embodiment 1 are not shown.

Figure 6A:
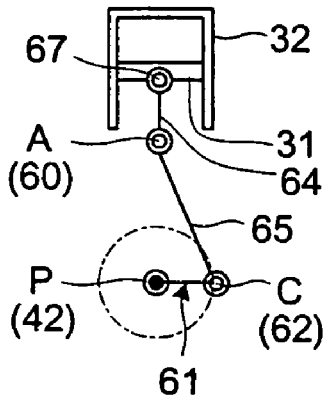
FIGS. 6A to 6C are schematic diagrams showing a link configuration of the piston-crank mechanism in the stirling engine according to embodiment 1 of the present invention.
Figure 6B:
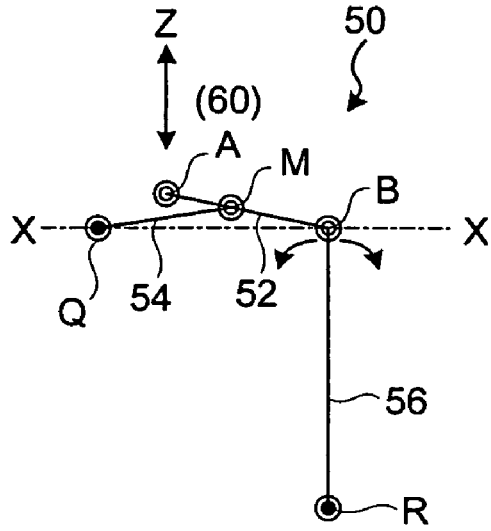
Figure 6C:
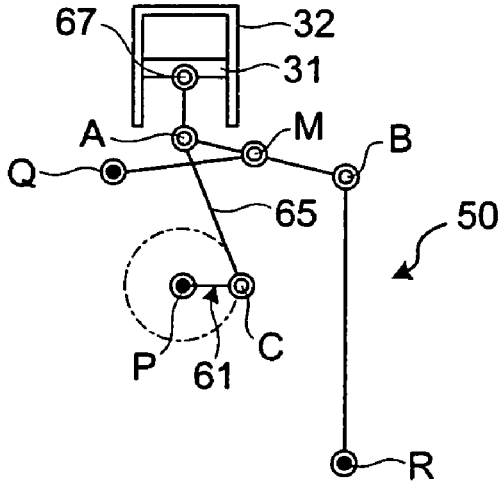

FIGS. 6(A) to (C) are schematic diagrams showing the link configuration of the piston-crank mechanism according to embodiment 1. In FIG. 6(A), only the cylinder 32, the piston 31, the connecting rod 65, and the crankshaft 61 are shown. In FIG. 6(B), only the linear approximation mechanism 50 is shown. In FIG. 6(C), the same mechanism as that shown in FIG. 5 is shown, wherein the configurations shown in FIGS. 6(A) and (B) are combined.

In FIGS. 6(A) to (C), various types of coupling points are shown:

(1) locomotive coupling point A: the central axis of the piston pin 60 (FIG. 5);

(2) locomotive coupling point B: the coupling point at the opposite end of the locomotive coupling point A of the first lateral link 52;

(3) locomotive coupling point C: the coupling point at the opposite end of the locomotive coupling point A of the connecting rod 65;

(4) locomotive coupling point M: the coupling point at the middle point of the first lateral link 52;

(5) supporting point P: the central axis (driving shaft) of the crankshaft 61;

(6) supporting point Q: the coupling point at the opposite end of the locomotive coupling point M of the second lateral link 54; and (7) supporting point R: the coupling point at the opposite end of the locomotive coupling point B of the longitudinal link 56.

The locomotive coupling point A is on the central axis of the piston pin 60 and moves up and down along the vertical direction indicated by an arrow Z (see FIG. 6(B)) as the piston 31 reciprocates. In the specification, the vertical direction Z indicates the direction along the axial centerline (center of axis) of the cylinder 32. The locomotive coupling points A and B are the coupling points at the ends of the first lateral link 52. The locomotive coupling point B travels on an arc trajectory as the longitudinal link 56 rotationally moves around the supporting point R. The locomotive coupling point B is disposed so that it may stay at substantially the same level X with the supporting point Q of the second lateral link 54 in the vertical direction.

Note that if the length of the longitudinal link 56 is virtually set to infinity so that the locomotive coupling point B may move linearly on the same level X in the vertical direction as the supporting point Q, the locomotive coupling point A moves along an substantially straight line in the vertical direction Z. In practice, since the length of the longitudinal link 56 is finite, the locomotive coupling point A travels on a trajectory slightly deviated from a trajectory of the linear motion (mentioned later in detail). Though a mechanism that realizes a substantially complete linear motion may be achievable through the use of a guide, which linearly guides the locomotive coupling point B instead of the longitudinal link 56, friction between the guide and the locomotive coupling point B would increase. Hence, for the friction reduction, the linear approximation mechanism 50 according to embodiment 1 is more preferable than the mechanism that realizes a complete linear motion.

The position of the locomotive coupling point M at the middle point of the first lateral link 52 is set so that the following relation is satisfied:

$$AM \times QM = BM^2$$

Here, AM, QM, and BM indicate the distances between the coupling points A and M, between the coupling pints Q and M, and between the coupling points B and M, respectively.

Figure 7:
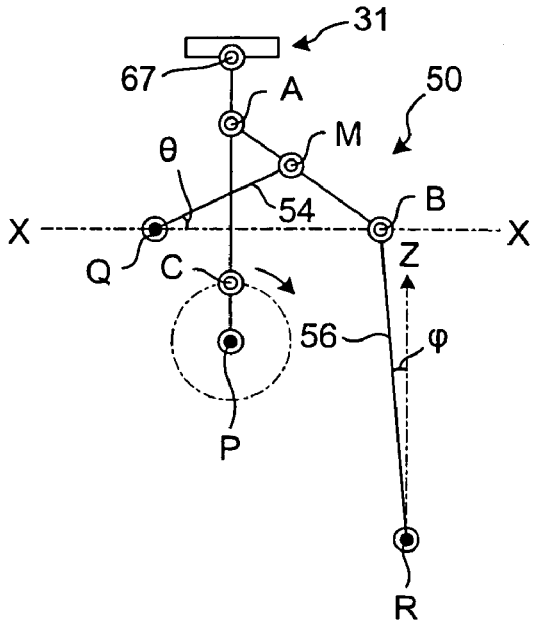
FIG. 7 is a primary schematic diagram showing a variation in shape of the piston-crank mechanism during the piston strokes in the stirling engine according to embodiment 1 of the present invention.
Figure 8:
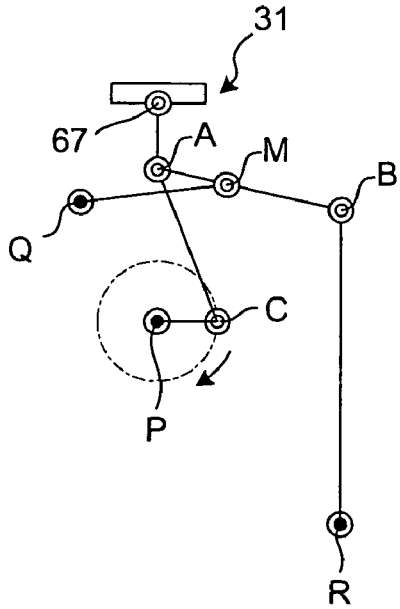
FIG. 8 is another schematic diagram showing a variation in shape of the piston-crank mechanism during the piston strokes in the stirling engine according to embodiment 1 of the present invention.

FIGS. 7 to 10 show a variation in shape of the piston-crank mechanism during the movement of the piston 31. As can be seen from the drawings, among three locomotive coupling points A, B, and M, the locomotive coupling points A and M travel a substantial amount as the piston 31 moves, while the locomotive coupling point B at the top of the longitudinal rink 56 moves little. In FIG. 7, two angles θ and ϕ are shown, which may be used as indicators of the degree of variation in shape of the linear approximation mechanism 50. The first angle θ is an angle ∠MQX of the second lateral link 54 measured relative to the horizontal direction X. The second angle ϕ is an angle ∠BRZ which is an inclination angle of the longitudinal link 56 measured relative to the vertical direction Z. A range of values the angles θ and ϕ may take, depends on the setting of a movable range of the locomotive coupling point A (i.e., the stroke of the piston 31) and the length of each link of the linear approximation mechanism 50.

As aforementioned, the bottom of the piston 31 and the top of the piston support 64 are rotatably coupled to one another by means of the pin 67. This configuration is advantageous in that even if the trajectory drawn by the bottom of the piston support 64 deviates slightly from the linear line, the deviation does not function as a force to incline the piston 31 (i.e., the deviation of the bottom of the piston support 64 doe not have substantial effect on the piston 31). In other words, to absorb deviation from linear motion, which may occur when the grasshopper mechanism 50 reciprocates, the piston 31 and the piston support 64 are relatively-movably but not rigidly coupled (in a free state) to one another. For example, in embodiment 1, the piston 31 and the piston support 64 are coupled to one another by means of the pin 67. The coupling in embodiment 1 has an additional advantage that the assembly of the piston to the linear approximation mechanism and the connecting rod can more readily performed compared with the integral-formed piston and piston support. On the other hand, integral forming of the piston 31 and the piston support 64 also offers an advantage in that even if the piston 31 is inclined relative to the cylinder 32 for some reason, the inclination may be corrected when the piston support 64 makes approximately linear motion.

Figures 11, 12:
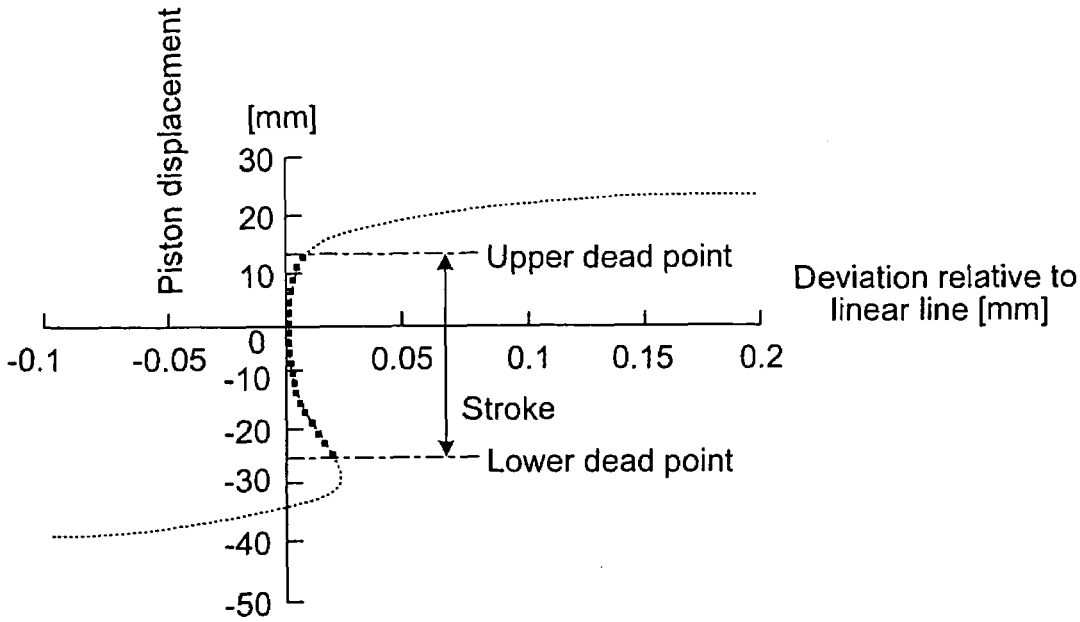
FIG. 11 is a table showing an example of specific dimension of the piston-crank mechanism of the stirling engine according to embodiment 1 of the present invention.
FIG. 12 is a schematic diagram showing a trajectory drawn by a locomotive coupling point A of the stirling engine according to embodiment 1 of the present invention.

FIG. 11 is a table showing an example of the specific dimensions of the piston-crank mechanism according to embodiment 1. FIG. 12 is a schematic diagram showing the trajectory drawn by the locomotive coupling point A. As known from FIG. 11, the dimensions shown in the figure satisfy the aforementioned relation ($AM \times QM = BM^2$). As shown in FIG. 12, the trajectory drawn by the locomotive coupling point A has an approximately linear line segment, which in turn, is utilized as a coverage of the stroke of the piston 31. The stroke coverage is set so that the deviation from the linear line at the upper dead point may be smaller than the deviation at the lower dead point. Herein, "the linear line" of the sentence "the deviation from the linear line . . . " indicates a centerline in the direction of the axis of the cylinder 32. In the example shown in FIG. 12, the deviations are approximately 5 μm at the upper dead point and 20 μm at the lower dead point, respectively.

The deviation from the linear line of the locomotive coupling point A at the upper dead point must be set smaller than the deviation at the lower dead point, because a force of the compressed air works on the piston 31 in the vicinity of the upper dead point (similarly, in the high-temperature power piston, because a force of the expanded air works on the piston 21 in the vicinity of the upper dead point). When the deviation at the upper dead point is smaller, an accordingly smaller thrust (side force) is generated by the force of the compressed air and works on the piston 31 (or that is generated by the force of the expanded air and works on the piston 21), thereby allowing for reduction in friction produced between the piston 31 and the cylinder 32 (or between the piston 21 and the cylinder 22). On the other hand, since force of the compressed air (or the expanded air) does not work on the piston at the lower dead point, slight deviation has a little effect on friction compared with the influence at the upper dead point.

Note that the approximately linear line segment of the trajectory drawn by the locomotive coupling point A may be lengthened via increase in the lengths of links 52, 54, and 56. The increased lengths of the links would lead to the larger linear approximation mechanism 50. In other words, a trade-off relation lies between the deviation from the linear line 50 at the upper or lower dead point and the size of the linear approximation mechanism 50. In view of the above, the linear approximation mechanism is preferably configured so that the deviations of the locomotive coupling point A from the linear line at the upper and lower dead points of the piston 31 may approximately 10 μm or less and approximately 20 μm or less, respectively, when measured at room temperature.

Figure 9:
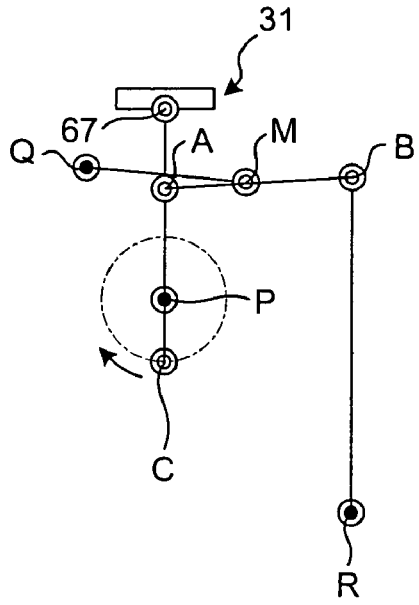
FIG. 9 is a still another schematic diagram showing a variation in shape of the piston-crank mechanism during the piston strokes in the stirling engine according to embodiment 1 of the present invention.
Figure 10:
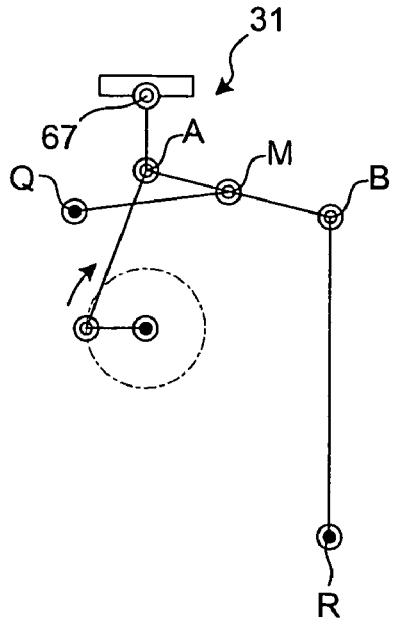
FIG. 10 is still further schematic diagram showing a variation in shape of the piston-crank mechanism during the piston strokes in the stirling engine according to embodiment 1 of the present invention.

When the stroke coverage of the piston 31 is set as shown in FIG. 12, the angle θ of the second lateral link 54 takes a value within a range of 8.8° to −17.9° (FIG. 11). The maximum value (8.8°) of the angle θ is obtained when the piston 31 is positioned at the upper dead point (FIG. 7), whereas the minimum value (−17.9°) is obtained when the piston 31 is positioned at the lower dead point (FIG. 9). The angle ϕ of the longitudinal link 56 takes a value within a range of 0° to 2.2°. The minimum value (0°) of the angle ϕ is obtained when the coupling points Q, A, M, and B are positioned substantially on a straight line, whereas the maximum value (2.2°) is obtained when the absolute value of the angle θ takes a maximum value (at the lower dead point in the example). Note that the value ranges of the angles θ and ϕ depend on the size of each link of the linear approximation mechanism 50 and the setting of the stroke coverage of the piston 31.

B. An Example of Specific Shape

Figure 13:
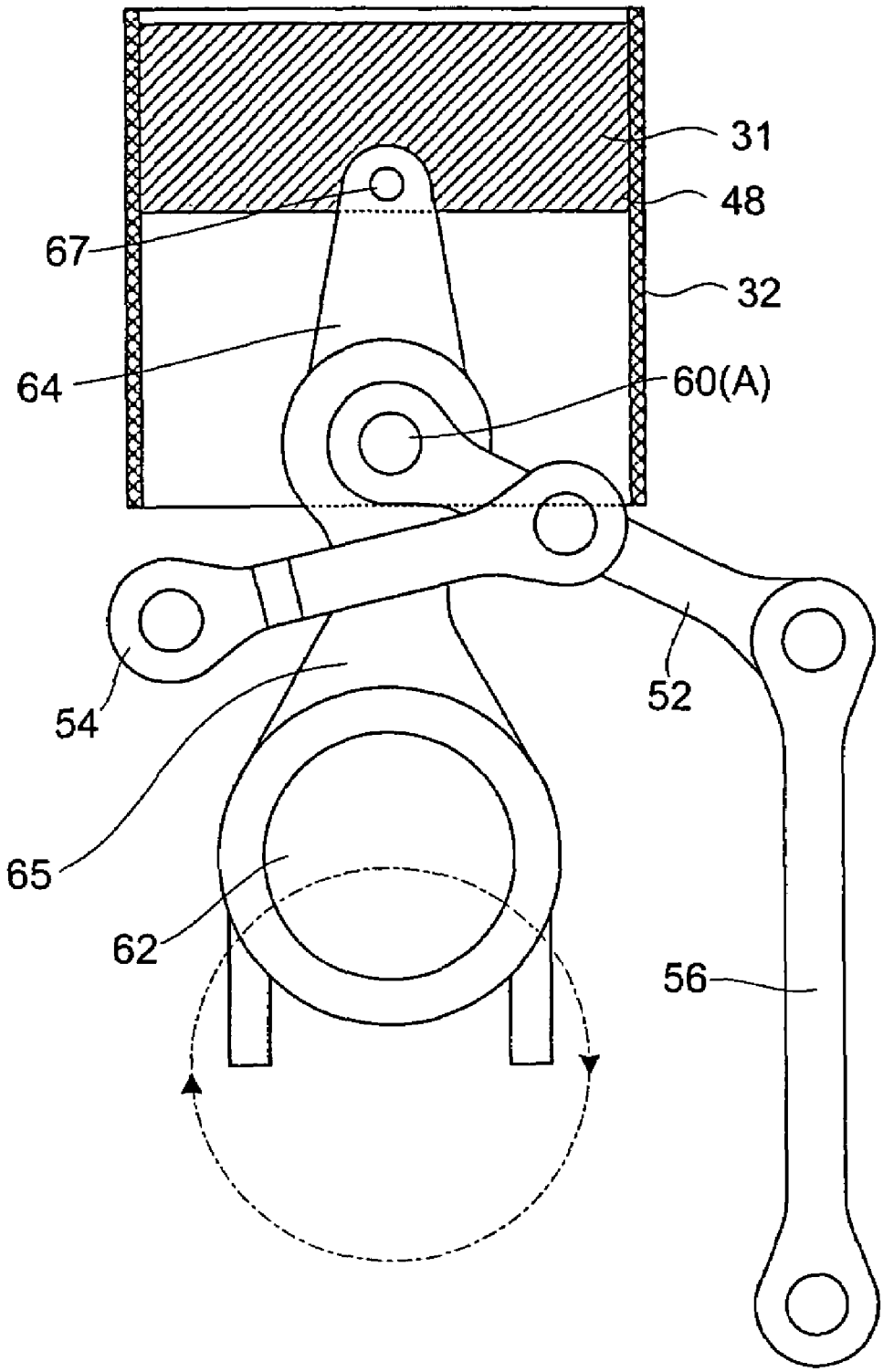
FIG. 13 is a longitudinal sectional view of relevant parts showing an example of the specific shape of the piston-crank mechanism of the stirling engine according to embodiment 1 of the present invention.
Figure 14:
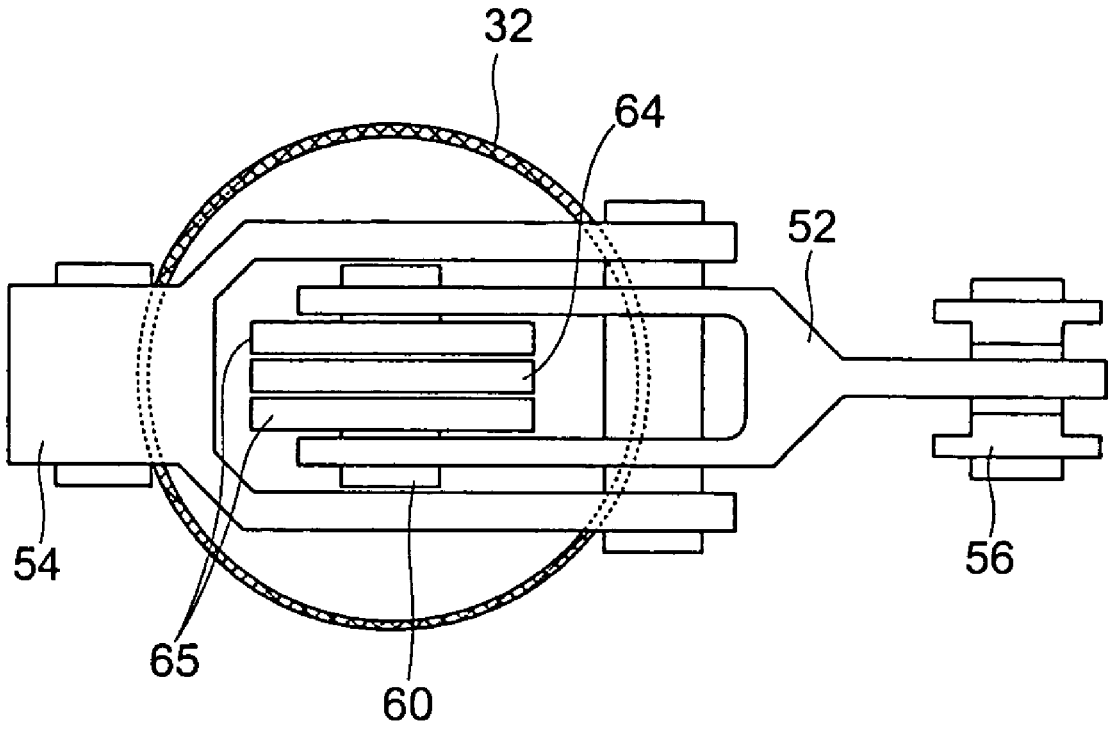
FIG. 14 is a transverse sectional view of the relevant parts of the piston-crank mechanism shown in FIG. 13.

FIGS. 13 and 14 show an example of the specific shape of the piston-crank mechanism according to embodiment 1. As aforementioned, the piston 31 has a cylindrical shape. On the outer surface of the piston 31, no grooves for the piston rings and the piston rings themselves are provided. The shape of the piston 31 in the plan view (transverse sectional view) is a highly precise circle. The cylinder 32 has a cylindrical shape and the shape of its inner surface in the plan view is a highly precise circle. As aforementioned, the air bearing 48 is disposed between the outer surface of the piston 31 and the inner surface of the cylinder 32. The highly precise circularity of the shapes in the plan views of the inner surface of the piston 31 and the inner surface of the cylinder 32 realize the air bearing with high sealing performance.

To ensure a distance equal to or longer than a predetermined dimension between the piston pin 60 and the piston 31, the piston support 64 is disposed between the piston pin 60 and the piston 31. Since the given dimension or a longer distance is kept between the piston pin 60 and the piston 31 by means of the piston support 64, the piston 31 is prevented from coming into contact with the linear approximation mechanism 50 during reciprocating movement of the piston 31.

The length of the piston support 64 is preferably set so that the length from the top of the piston 31 to the piston pin 60 is approximately ½×(the stroke of the piston 31) or larger and less than 1×(the stroke of the piston 31). It is because that if the piston support 64 is excessively short, the linear approximation mechanism 50 may hit the cylinder 32 or the piston 31 at the upper dead point. On the other hand, if the piston support 64 is excessively long, more energy is lost according to the increase in weight.

As shown in FIG. 14, the piston support 64, the connecting rod 65, and the first and second lateral links 52, 54 are configured so that they may not interfere with each other when the piston 31 strokes up and down. Specifically, in the example of FIG. 14, the piston support 64 is disposed at the axial center of the cylinder 32 and two plate members of the connecting rod 65 sandwich the piston support 64 from two sides. Two plate members of the first lateral link 52 are placed outside the connecting rod 65. These three types of members 52, 64, and 65 are coupled to each other by means of the piston pin 60. Further outside of the first lateral link 52, two plate members of the second lateral link 54 are placed. In brief, in this example, each of the connecting rod 65 and two lateral links 52 and 54 has a forked end where each tine of the fork is formed from a plate member, and is disposed as to sandwich the piston support 64 in the center from two sides.

Figure 15:
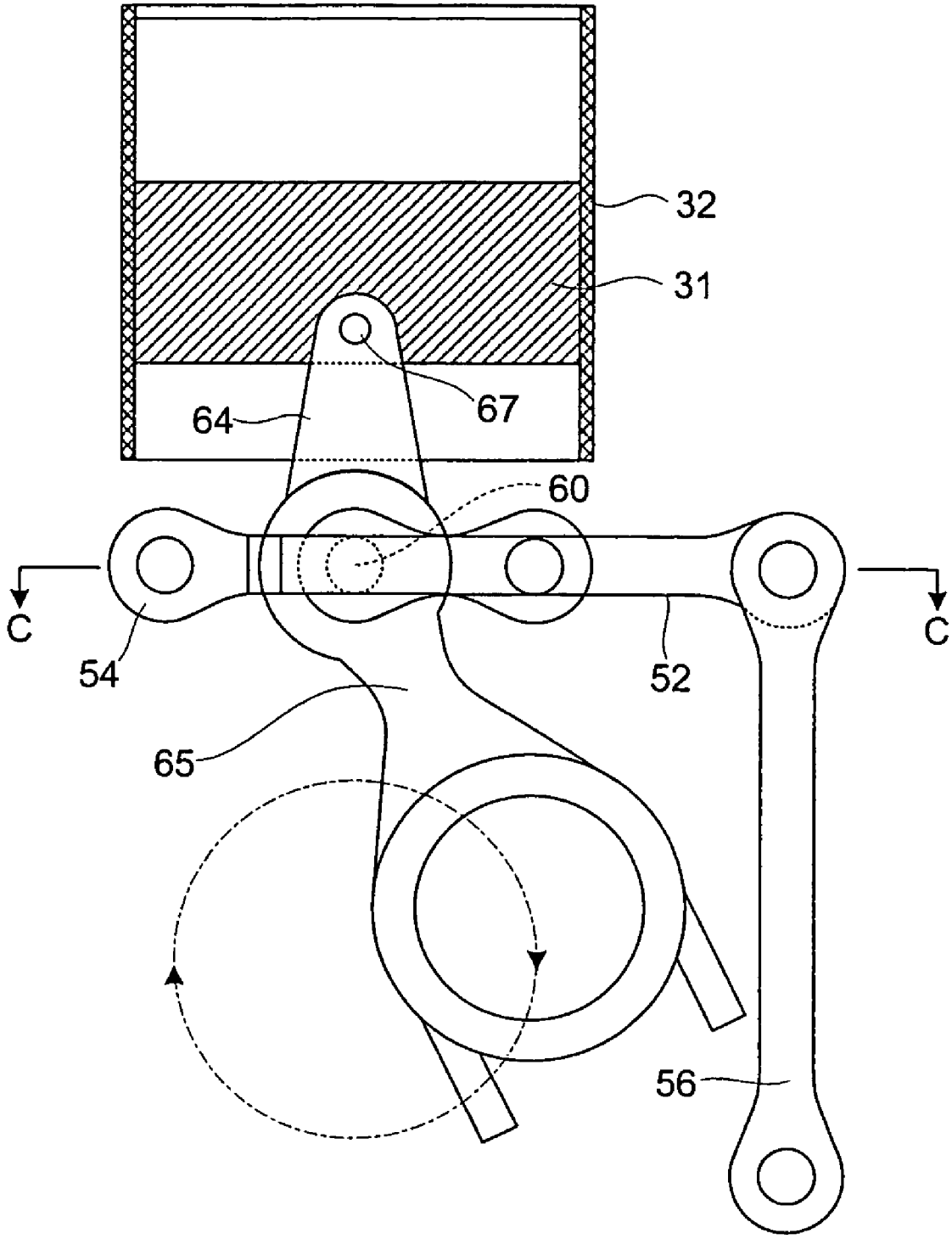
FIG. 15 is a longitudinal sectional view of the relevant parts of the piston-crank mechanism at a position where the crank has rotationally moved from the state shown in FIG. 13.
Figure 16:
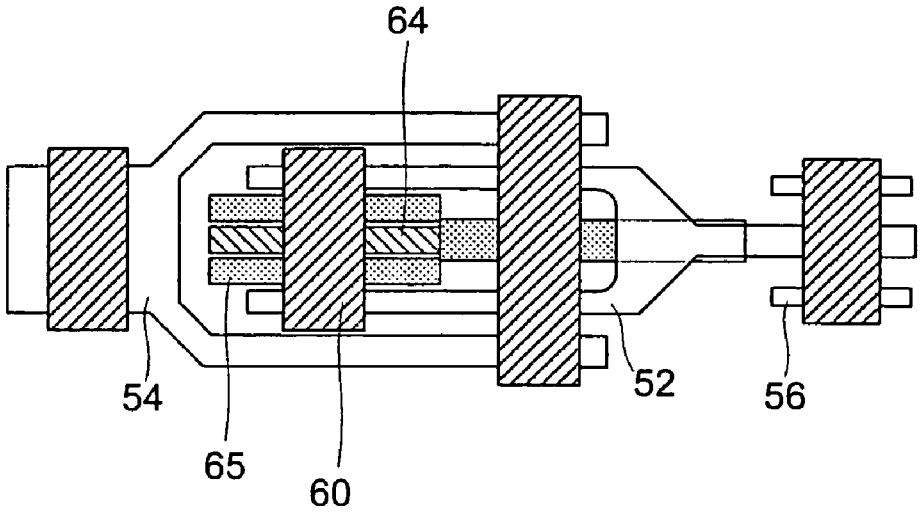
FIG. 16 is a transverse sectional view of the relevant parts of the piston-crank mechanism shown in FIG. 15.

FIG. 15 is a longitudinal sectional view showing the relevant parts of the piston-crank mechanism at a position where the crank rotates from the position in FIG. 13 and the lateral links 52, 54 are horizontally positioned. FIG. 16 is a sectional view along a line C-C in FIG. 15. Note that in FIG. 16, the connecting rod 65 and the piston support 64 are crosshatched for easy recognition.

Figure 17:
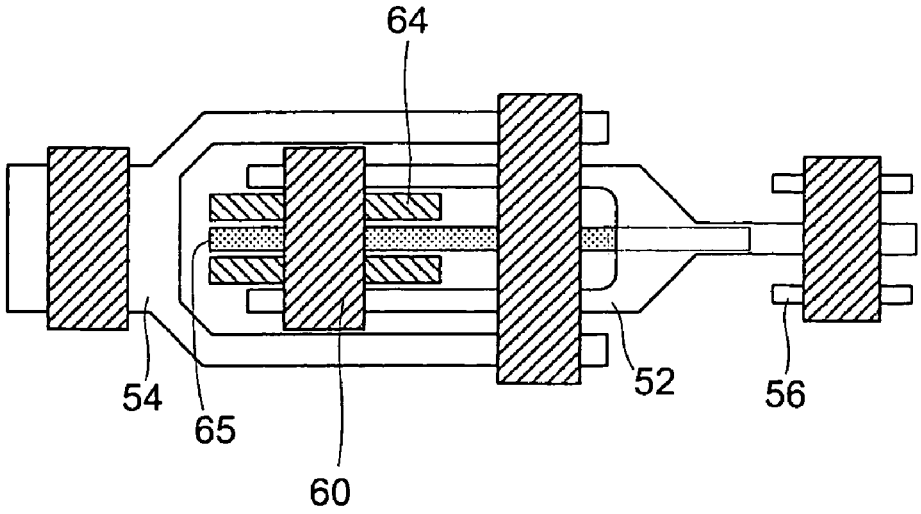
FIG. 17 is a transverse sectional view showing a relevant parts of a modified coupling element of the piston-crank mechanism of the stirling engine according to embodiment 1 of the present invention.

FIGS. 17 to 21 show various types of possible shapes and physical relations (coupling conditions) of the piston support 64, the connecting rod 65, and the first lateral link 52. FIG. 17 shows the physical relation between the connecting rod 65 and the piston support 64, wherein the positions of the connecting rod 65 and the piston support 64 in FIG. 16 are interchanged. In other words, in FIG. 17, the connecting rod 65 is placed at the center, outside of which the two-forked element of the piston support 64 is disposed, further outside of which the two-forked element of the first lateral link 52 is disposed. At the outermost position, the two-forked element of the second lateral link 54 is disposed.

Figure 18:
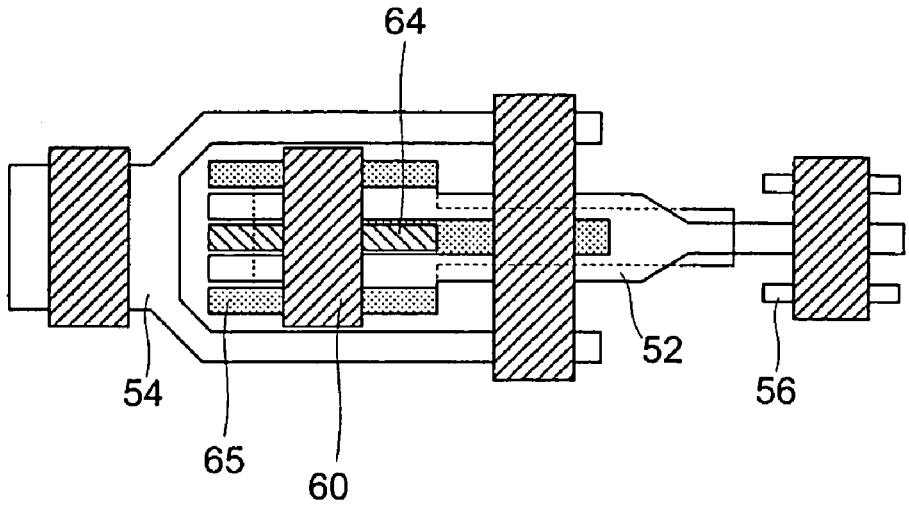
FIG. 18 is a transverse sectional view showing a relevant parts of another modified coupling element of the piston-crank mechanism of the stirling engine according to embodiment 1 of the present invention.

FIG. 18 shows the physical relation between the connecting rod 65 and the first lateral link 52, wherein the positions of the connecting rod 65 and the first lateral link 52 in FIG. 16 are interchanged. In other words, in FIG. 18, the piston support 64 is placed at the center, outside of which the two-forked element of the first lateral link 52 is disposed, further outside of which the two-forked element of the connecting rod 65 is disposed.

Figure 19:
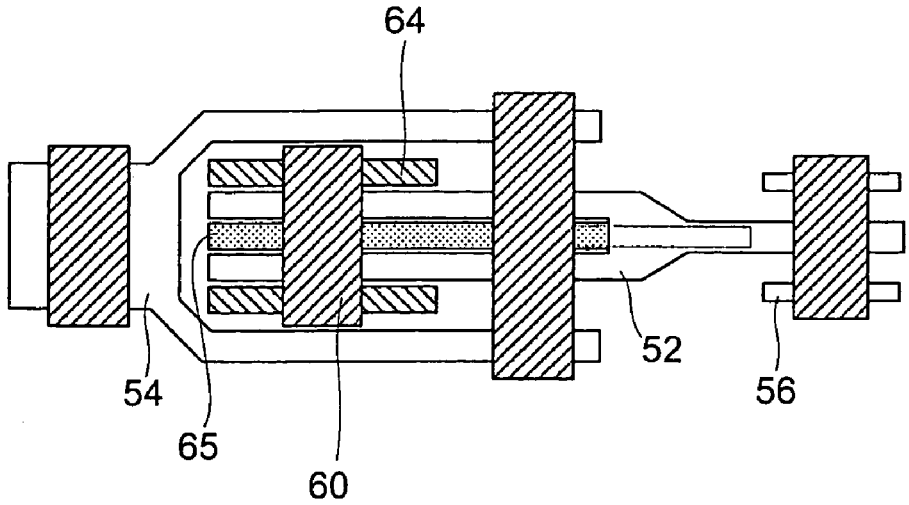
FIG. 19 is a transverse sectional view showing a relevant parts of still another modified coupling element of the piston-crank mechanism of the stirling engine according to embodiment 1 of the present invention.

FIG. 19 shows the physical relation between the piston support 64 and the first lateral link 52, wherein the positions of the piston support 64 and the first lateral link 52 in FIG. 17 are interchanged. In other words, in FIG. 19, the connecting rod 65 is placed at the center, outside of which the two-forked element of the first lateral link 52 is disposed, further outside of which the two-forked element of the piston support 64 is disposed.

Figure 20:
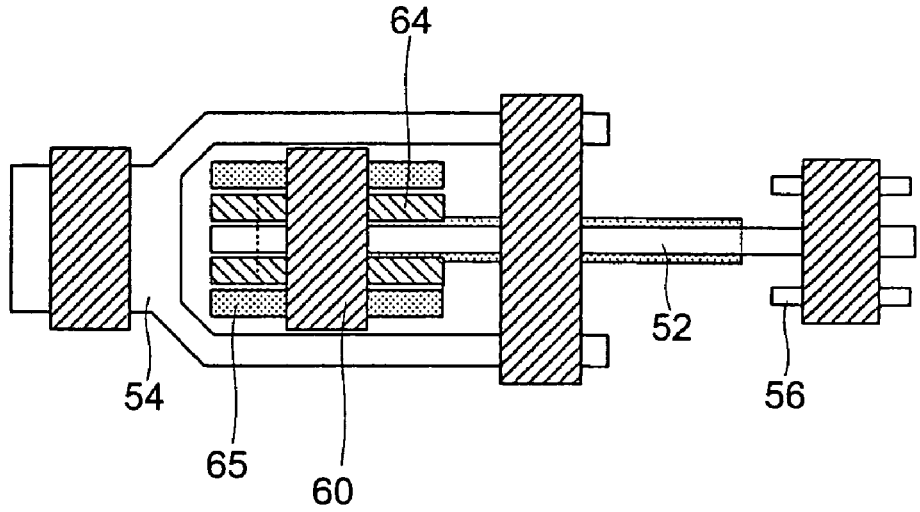
FIG. 20 is a transverse sectional view showing a relevant parts of still further modified coupling element of the piston-crank mechanism of the stirling engine according to embodiment 1 of the present invention.

FIG. 20 shows the physical relation between the piston support 64 and the first lateral link 52, wherein the positions of the piston support 64 and the first lateral link 52 in FIG. 18 are interchanged. In other words, in FIG. 20, the first lateral link 52 is placed at the center, outside of which the two-forked element of the piston support 64 is disposed, further outside of which the two-forked element of the connecting rod 65 is disposed.

Figure 21:
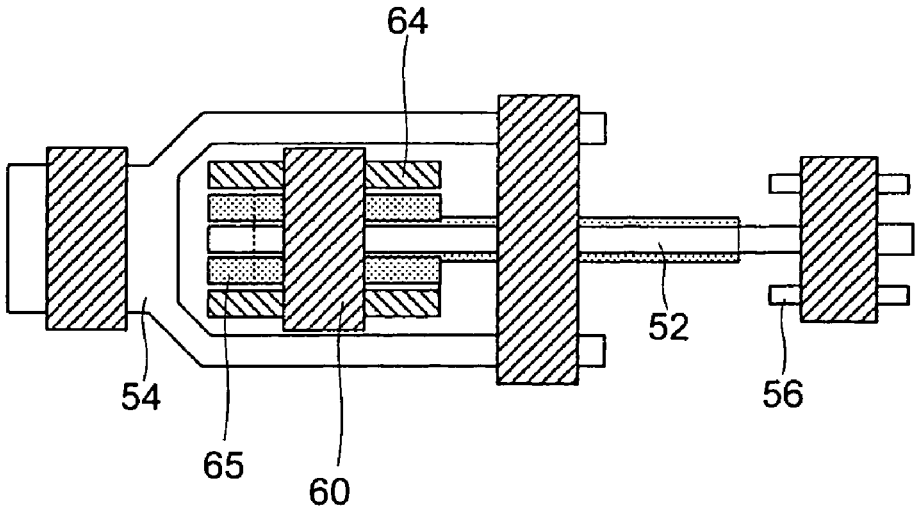
FIG. 21 is a transverse sectional view showing a relevant parts of still further modified coupling element of the piston-crank mechanism of the stirling engine according to embodiment 1 of the present invention.

FIG. 21 shows the physical relation between the piston support 64 and the connecting rod 65, wherein the positions of the piston support 64 and the connecting rod 65 in FIG. 17 are interchanged. In other words, in FIG. 21, the first lateral link 52 is placed at the center, outside of which the two-forked element of the connecting rod 65 is disposed, further outside of which the two-forked element of the piston support 64 is disposed.

In any of FIGS. 16 to 21, the second lateral link 54 has a two-forked end and is placed outside of other members 64, 65, 52, and 60. When the linear approximation mechanism operates, the end of the first lateral link 52 passes between the fork ends of the second lateral link 54. According to this configuration, even if the connecting rod 65 is shorter, the ends of the first and second lateral links 52 and 54 do not interfere with one another. Hence, the increase in longitudinal dimension of the piston-crank mechanism can be prevented.

Moreover, in the configurations shown in FIGS. 16 to 21, the end of the first lateral link, the bottom of the piston support 64 (the bottom of the piston), and the top of the connecting rod 65 are coupled to each other by means of the single piston pin 60. According to this configuration, in which the first lateral link 52, the piston support 64, and the connecting rod 65 are coupled to each other by means of the single piston pin 60, the structures of the coupling points may be simplified and become compact.

Furthermore, in the configurations shown in FIGS. 16 to 21, two among three ends, i.e., the end of the first lateral link 52, the bottom of the piston support 64, and the top of the connecting rod 65, have a two-forked structure, and the remaining one has been sandwiched between the folks of the two other ends. In such configuration, the coupling points among the first lateral link 52, the piston support 64, and the connecting rod 65 are disposed symmetrically. Hence, side force is prevented from being generated due to asymmetrical arrangement.

Note that the physical relation among these members 64, 65, 52, and 54 may be different from those shown FIGS. 16 to 21.

Figure 22:
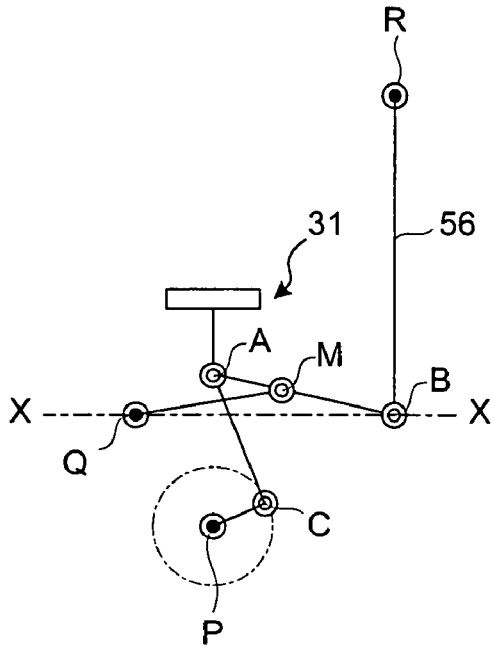
FIG. 22 is another transverse sectional view showing a sixth aspect of the coupling element of the piston-crank mechanism of the stirling engine according to embodiment 1 of the present invention.
Figure 23:
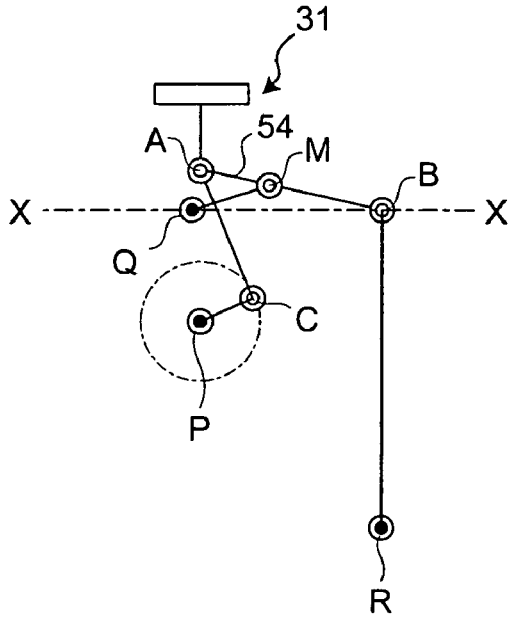
FIG. 23 is a schematic diagram showing another modification of the piston-crank mechanism of the stirling engine according to embodiment 1 of the present invention.
Figure 24:
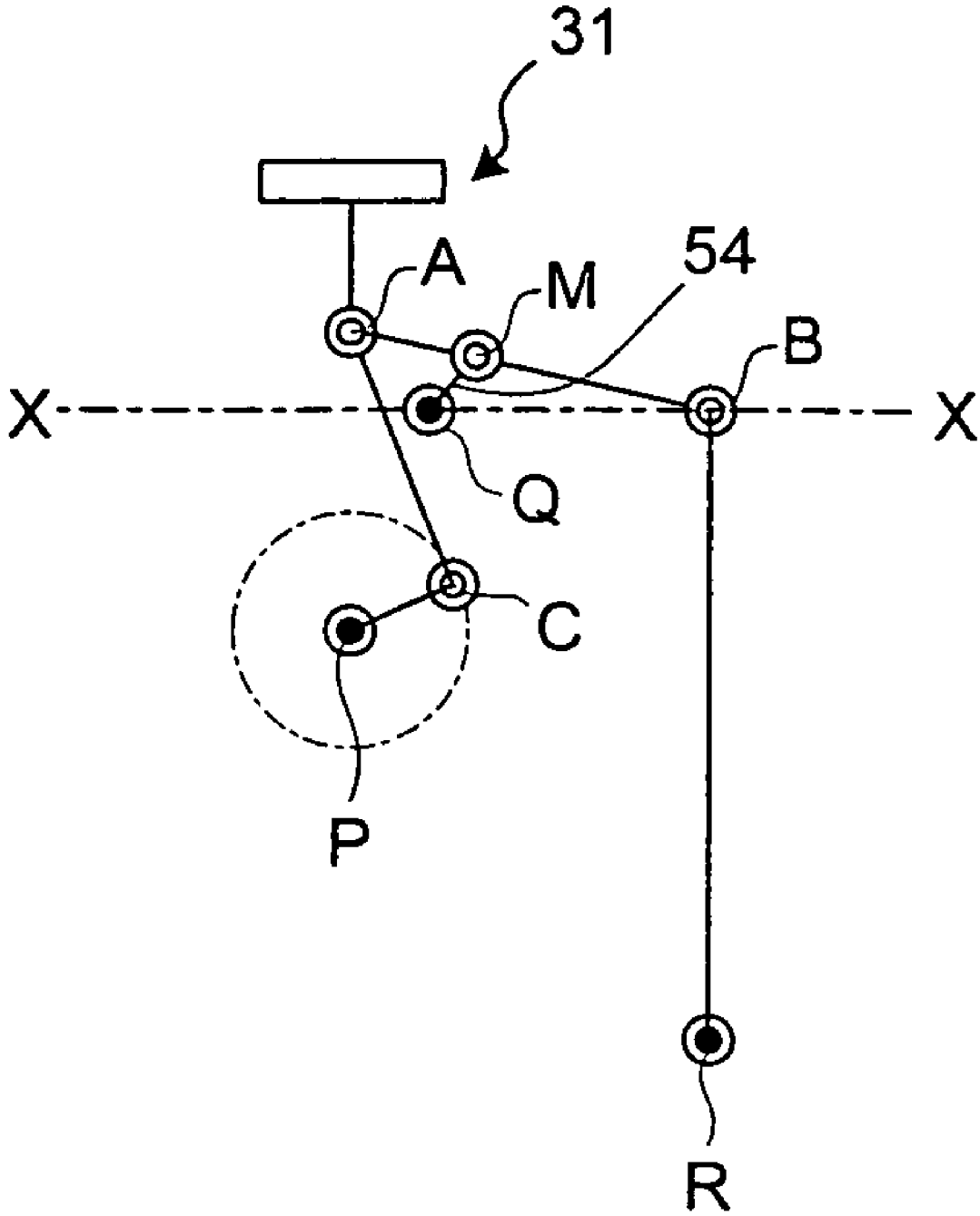
FIG. 24 is a schematic diagram showing still another modification of the piston-crank mechanism of the stirling engine according to embodiment 1 of the present invention.

FIGS. 22 to 24 are schematic diagrams showing modifications of the piston-crank mechanism according to embodiment 1. In FIG. 22, the longitudinal link 56 of the mechanism shown in FIGS. 6(A) to (C) is placed above the coupling point B and other portions remain unchanged from embodiment 1. The mechanism shown in FIG. 22 has the same effect as that of the mechanism according to embodiment 1.

In FIG. 23, the supporting point Q of the mechanism according to embodiment 1 shown in FIGS. 6(A) to (C) is moved on the side of the locomotive coupling point B so that the supporting point Q is placed on the linear line segment connecting the locomotive coupling point A (piston pin) and the supporting point P (crankshaft) and other portions remain unchanged from embodiment 1. In the mechanism shown in FIG. 24, the supporting point Q is further moved to the right side. In the mechanisms shown in FIGS. 23 and 24, the second lateral link is shorter than in embodiment 1, and thus the mechanisms have an advantage of compactness. The mechanism shown in FIG. 23 has an advantage in that it provides better linearity than that of the mechanisms shown in FIGS. 23 and 24.

As can be seen from the above descriptions, according to embodiment 1 and modifications thereof, the linear approximation mechanism 50 is incorporated in the piston-crank mechanism so that the bottom of the piston 31 travels on the approximately linear trajectory drawn along the axial centerline of the cylinder 32. The piston 31, thereby, makes linear motion at a higher accuracy and the side force exerted on the piston 31 is reduced substantially to zero (0). This fixes a problem occurring in the case where the air bearing 48 with low resistance to pressures applied from the thrust direction is disposed between the piston 31 and the cylinder 32.

The grasshopper type of linear approximation mechanism is especially suited to control the movement of the piston of the stirling engine 10 because the point (locomotive coupling point A) moving on the approximately linear line is biased toward the vicinity of the one end of the mechanism. In addition, better linearity can be achieved with a compact mechanism.

The following items are disclosed in embodiment 1 and the modifications thereof.

The stirling engine according to the embodiment includes a cylinder, a piston reciprocating inside the cylinder while keeping an air-tight condition between the piston and the cylinder by means of a gas bearing, and an linear approximation mechanism coupled directly or indirectly to the piston so that the piston makes an approximately linear motion when reciprocating inside the cylinder.

The structure according to the embodiment employs a gas bearing in order to realize the piston mechanism of the stirling engine without the use of piston rings (i.e., ringless structure) and lubricant oil (i.e., oilless structure), and thus to reduce a frictional loss and to avoid deterioration of a heat exchanger by lubricant oil. The piston makes approximately linear motion by means of an linear approximation mechanism when reciprocating inside the cylinder. Accordingly, substantially no side force is exerted on the piston. Thus, the linear approximation mechanism is effective when used in combination with the gas bearing which has low resistance to the side force.

The gas bearing supports an object without contact by means of the pressure of the gas filled in a minute clearance between the gas bearing and the object. One type of the gas bearing has a so-called clearance-seal. For the gas filled in the clearance, the working fluid of the stirling engine may be used. One type of the gas bearing is an air bearing. From the standpoint of the simplification of the system configuration, a gas bearing that supports the object without contact by means of the pressure of the distributed gas is preferred to a gas bearing that functions with forcible blowing of the gas. Since the former type of gas bearing has a still lower resistance to the side force, such bearing is most suitably used in combination with the linear approximation mechanism, which substantially eliminates side force exerted on the piston.

The stirling engine according to the embodiment further includes a crankshaft rotating around a driving shaft, an extension protruding downward from the piston, and a connecting rod coupling the extension and the crankshaft, and is characterized in that the linear approximation mechanism is coupled to a coupling element between the extension and the connecting rod to control the movement of the coupling element so that the coupling element makes an approximately linear motion along the axial centerline of the cylinder. The extension may be provided as to extend downward from the piston along the axial centerline of the cylinder. The connecting rod is an element coupling the piston and the crankshaft. The linear approximation mechanism is coupled to the coupling element between the connecting rod and the piston which has the extension protruding downward to control the movement of the coupling element so that the coupling element may make an approximately linear motion along the axial centerline of the cylinder, wherein the coupling element is disposed in the extension.

According to the embodiment, coupling between the linear approximation mechanism and the piston at the extension may reduce possible interferences between the linear approximation mechanism and the piston and between the linear approximation mechanism and the cylinder. This enables the linear approximation mechanism to have a more compact size.

The stirling engine according to the embodiment is characterized in that the piston and the extension are rotatably coupled to one another. In this configuration, even if the trajectory drawn by the bottom of the extension slightly deviates from the linear line, the deviation may have substantially no effect on the piston.

The hybrid system according to the embodiment includes the stirling engine according to the embodiment and an internal combustion engine of a vehicle, wherein the stirling engine is mounted on the vehicle and a heater of the stirling engine is arranged to draw heat from an exhaust system of the internal combustion engine.

The stirling engine according to the embodiment, of which frictional loss is reduced through the use of the configuration aforementioned, may well operate even if a low-temperature heat source, such as the exhaust system of the internal combustion engine is used, and is preferably utilized for energy recovery from the low-temperature heat source. Thus, the stirling engine according to embodiment 1 is suitable for building of the hybrid system.

The stirling engine according to the embodiment includes a cylinder, a piston reciprocating inside the cylinder while keeping an air-tight condition by means of a gas bearing, a crankshaft rotating around a driving shaft, a connecting rod coupling the piston and the crankshaft, and an linear approximation mechanism coupled to a coupling element between the piston and the connecting rod. The linear approximation mechanism controls the movement of the coupling element so that the coupling element may make an approximately linear motion along the axial centerline of the cylinder.

According to the embodiment, the piston has a piston head, which is a part of the top of the piston, and a piston support (extension member) extending under the piston head along the axial centerline of the cylinder, wherein the coupling element between the piston and the connecting rod is disposed at the bottom of the piston support. The piston head and the piston support are rotatably coupled to one another.

According to the embodiment, the linear approximation mechanism is configured so that a first deviation of the coupling element from the axial centerline of the cylinder at the upper dead point of the piston is smaller than a second deviation of the coupling element from the axial centerline of the cylinder at the lower dead point of the piston. The deviation at the upper dead point is set smaller than the deviation at the lower dead point in the embodiment, because in the low-temperature power piston, a force of the compressed air is exerted on the compressing piston in the vicinity of the upper dead point, and similarly in the high-temperature power piston, a force of the expanded air is exerted on the expanding piston in the vicinity of the upper dead point. This means that the smaller the deviation at the upper dead point is, the smaller a thrust (lateral force) generated by the force of the compressed air and the expanded air and working on the compressing piston and the expanding piston, respectively, becomes. Thus the smaller deviation at the upper dead point serves to allow for the reduction in friction between the piston and the respective cylinders. On the other hand, since no force of the compressed air (or the expanded air) is exerted on the piston at the lower dead point, slight deviation has a less effect on friction than at the upper dead point.

According to the embodiment, a grasshopper type mechanism is preferably used as the linear approximation mechanism. The grasshopper mechanism, in which a point moving on the approximately linear line is biased toward the vicinity of one end of the mechanism, is, in particular, suited to control the piston movement of the piston engine, achieving better linearity with the compact size. Hence, the grasshopper type mechanism is suitably employed in combination with the stirling engine provided with a gas bearing.

The grasshopper mechanism has a first lateral link, a second lateral link, and a longitudinal link, wherein a first end of the first lateral link is rotatably coupled to the coupling element between the piston and the connecting rod, a second end of the first lateral link is rotatably coupled to a first end of the longitudinal link, a second end of the longitudinal link is rotatably fixed to the stirling engine at a predetermined point, a first end of the second lateral link is rotatably coupled to the first lateral link at a predetermined position in the middle of the first lateral link, and a second end of the second lateral link is rotatably fixed to the stirling engine at a predetermined point.

In the grasshopper mechanism described above, the first end of the second lateral link has a two-forked structure, wherein the first end of the first lateral link is configured to pass between the folk ends. In this configuration, no interference occurs between the first end of the first lateral link and the first end of the second lateral link even if a shorter connecting rod is used, whereby increase in longitudinal dimension of the piston engine of the stirling engine can be controlled.

In the grasshopper mechanism, the first end of the first lateral link and the coupling element between the piston and the connecting rod may be coupled to one another by mean of a single piston pin. According to this configuration, the first lateral link, the piston, and the connecting rod may be coupled to each other by means of the single piston pin, whereby the structure of the coupling element can be simplified.

In the grasshopper mechanism, among three ends, i.e., the first end of the first lateral link, the end of the piston at the coupling element between the piston and the connecting rod, and the end of the connecting rod at the coupling element, two ends have a two-forked structure, wherein the end of the remaining one may be disposed between the fork ends of the two other ends. In this configuration, since the coupling points of the first lateral link, the piston, and the connecting rod take a symmetrical structure, generation of side force which is incurred by an asymmetrical structure can be prevented.

Embodiment 2

Embodiment 2 of the present invention is described in detail below. Embodiment 2 relates to a piston device of the present invention.

Now, the present invention is described in detail in reference to the accompanying drawings. Note that the present invention is not limited to the embodiments described below. It should be noted that the components incorporated in the embodiments include those readily conceived by those skilled in the art and those substantially equivalent to those readily conceived by those skilled in the art. Note that though the stirling engine is described below by way of example of the piston engine, the present invention can be applied to other engines. For example, the present invention is also applicable to the piston engine other than the stirling engine and a stirling refrigerating machine.

In recent years, the stirling engine, which is one kind of piston engine with an excellent characteristic of high theoretical heat efficiency, widely attracts attention as a means for recovering heat such as heat exhausted from an internal combustion engine mounted on vehicles including automobiles and buses. To improve the heat efficiency of the stirling engine, it is essential to reduce the frictional loss. In the Patent Document 1, a technique is disclosed, by which the piston is caused to reciprocate on an approximately linear line by means of the linear approximation mechanism with a Watt link to reduce friction produced between the piston and the cylinder.

The piston engine disclosed in the Patent Document 1, however, uses the Watt link in the linear approximation mechanism, which results in protrusion of two horizontal pincer edges toward the direction perpendicular to the direction of reciprocating movement of the piston. For this reason, a larger crankcase is required to accommodate the Watt link, leading to a heavier piston engine. In view of the above inconvenience, an object of embodiment 2 is to provide a piston engine, of which housing may be downsized.

Embodiment 2 relates to the piston engine, of which housing may be downsized.

Figure 25:
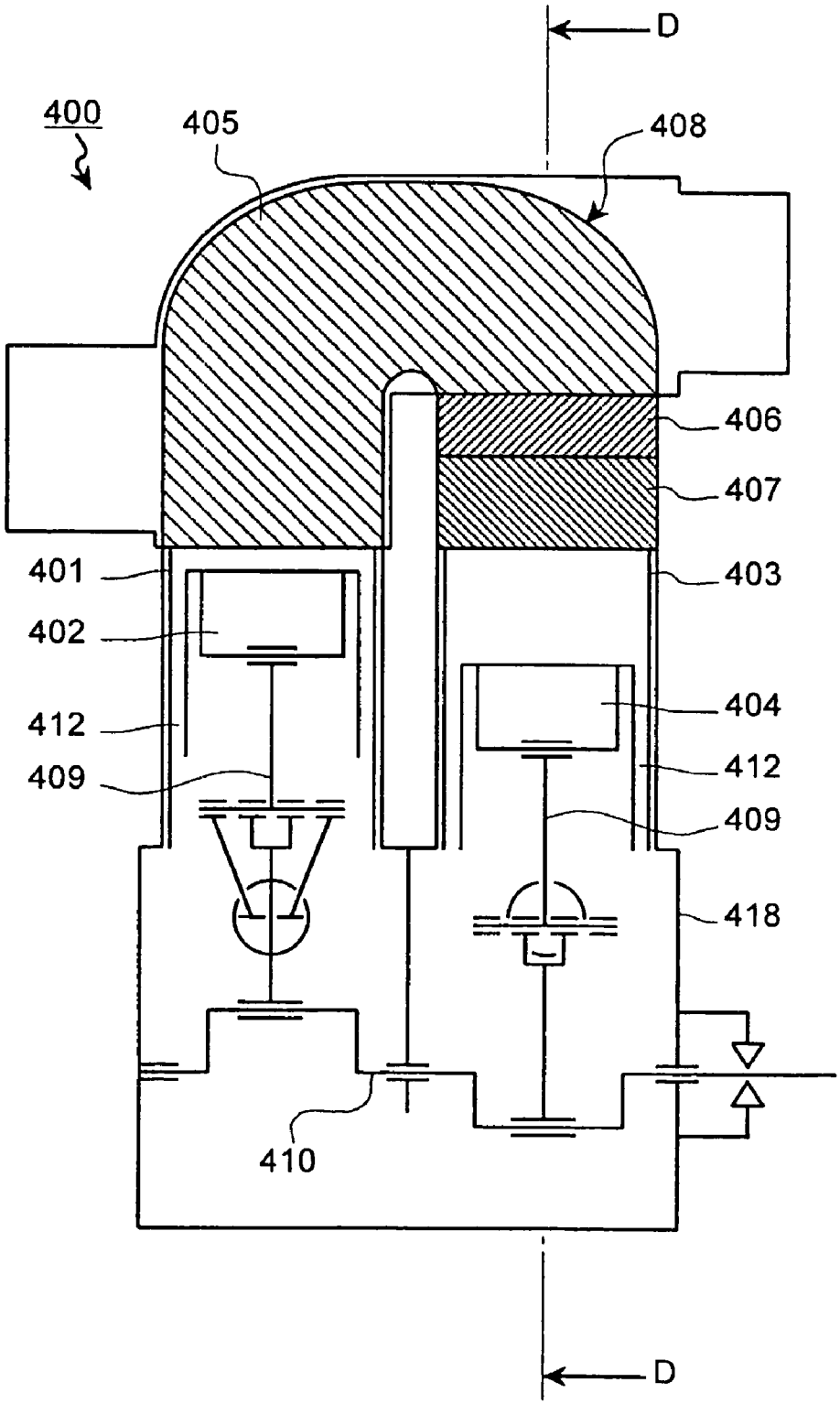
FIG. 25 is a sectional view showing a stirling engine having a cylinder support according to embodiment 2 of the present invention.
Figure 26:
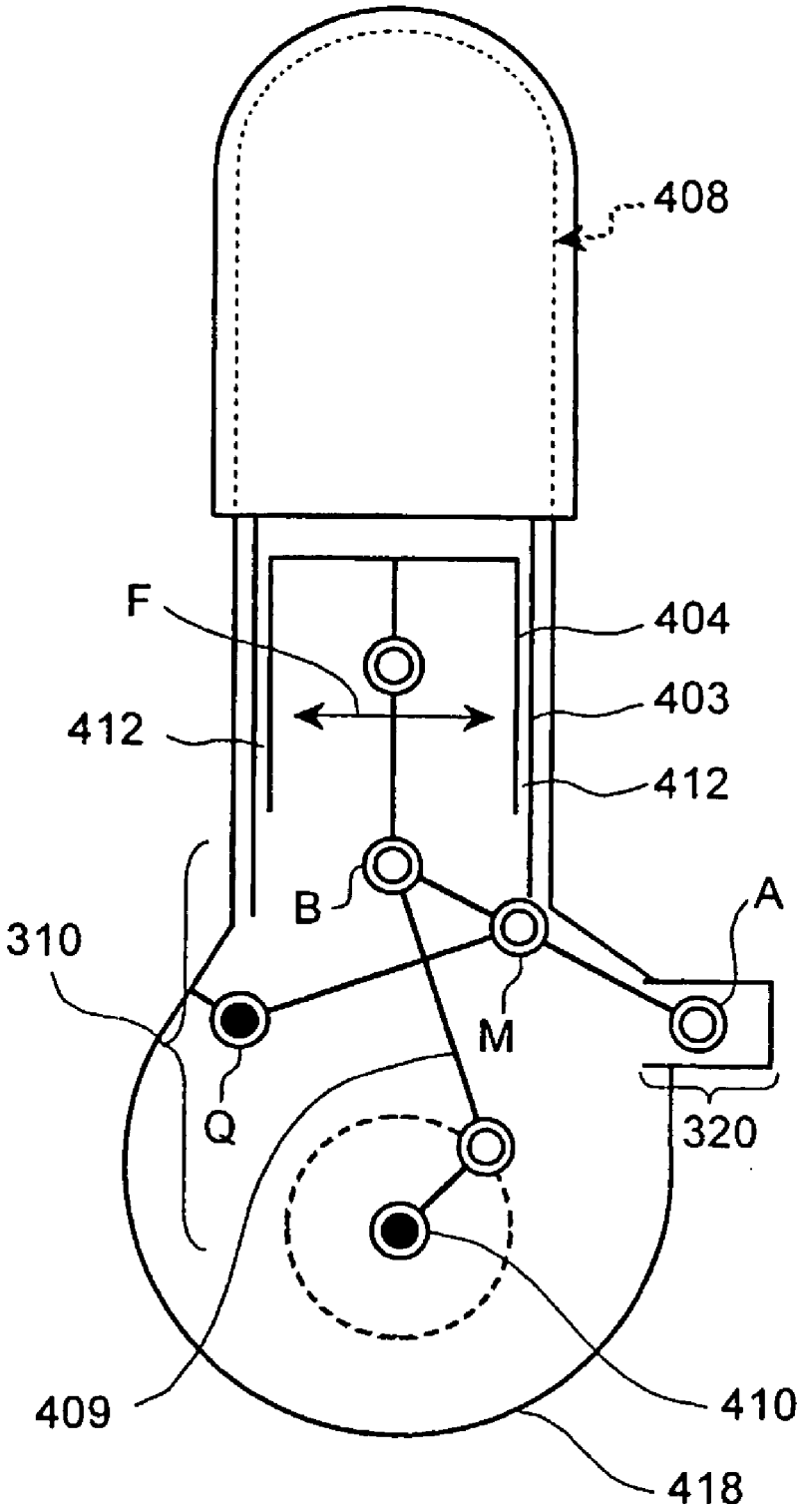
FIG. 26 is a sectional view taken from a direction of an arrow D shown in FIG. 25.

FIG. 25 is a sectional view showing a stirling engine with a cylinder support according to embodiment 2. FIG. 26 is a sectional view taken from a direction indicated by an arrow D in FIG. 25. The stirling engine 400, which is a piston engine, is a so-called a type in-line dual-cylinder stirling engine, and includes a high-temperature piston 402 in a high-temperature cylinder 401 and a low-temperature piston 404 in a low-temperature cylinder 403.

The high-temperature cylinder 401 and the low-temperature cylinder 403 are connected to one another by a heat exchanger 408 which includes a heater 405, a regenerator 406, and a cooler 407. One end of the heater 405 is connected to the high-temperature cylinder 401 and another end is connected to the regenerator 406. One end of the regenerator 406 is connected to the heater 405 and another end is connected to the cooler 407. One end of the cooler 407 is connected to the regenerator 406 and another end is connected to the low-temperature cylinder 403. The high-temperature and low-temperature cylinders 401, 403 are filled with a working fluid (herein, air) and establish stirling cycles using heat supplied by the heater 405 to drive the high-temperature piston 402 and the low-temperature piston 404.

The high-temperature piston 402 and the low-temperature piston 404 are supported inside the high-temperature cylinder 401 and the low-temperature cylinder 403 by means of an air bearing 412, respectively. This means that at the air bearing 412, the piston may be supported inside the cylinder with no piston ring. This reduces friction produced between the piston and the cylinder, allowing an improvement of the heat efficiency of the stirling engine 400. Reduction in friction between the piston and the cylinder enables the stirling engine to operate even under the conditions of a low-temperature heat source and small temperature gradient, for example, when the stirling engine recovers exhaust heat of an internal combustion engine 420.

To form the air bearing 412, several tens μm of clearance is left between the piston and the cylinder throughout the circumference of the piston. Note that the high-temperature cylinder 401, the high-temperature piston 402, the low-temperature cylinder 403, and the low-temperature piston 404 may be made from any materials with a high elasticity modulus such as ceramics but not limited to glass. The high-temperature cylinder 401, the high-temperature piston 402, the low-temperature cylinder 403, and the low-temperature piston 404 may be made from a combination of different materials. To manufacture the high-temperature cylinder 401, the high-temperature piston 402, the low-temperature cylinder 403, and the low-temperature piston 404, metal materials with high workability may be used.

The reciprocating motion of each of the high-temperature piston 402 and the low-temperature piston 404 is transmitted to a crankshaft 410 by means of a connecting rod 409 and converted into a rotation. The connecting rod 409 is supported by means of an linear approximation mechanism 310 shown in FIG. 26. Thus, each of the high-temperature piston 402 and the low-temperature piston 404 reciprocates on an approximately linear line. The linear approximation mechanism 310 is described in detail later. Thus, with the connecting rod 409 supported by means of the linear approximation mechanism 310, each of the high-temperature and the low-temperature pistons 402, 404 has substantially zero (0) side force (force exerted in the radial direction of the piston). Accordingly, the piston can be well supported by means of the air bearing 412 with low loading capacity. Here, the connecting rod 409, the crankshaft 410, and the linear approximation mechanism 310 are enclosed in the crankcase 418, which is a sealed housing. Through pressurization of the inside of the crankcase 418, the working fluid in the high-temperature cylinder 401, the heat exchanger 408, and the low-temperature 403 are indirectly pressurized to improve the output from the stirling engine 400. Next, the linear approximation mechanism 310 according to embodiment 2 is described.

Figure 27A:
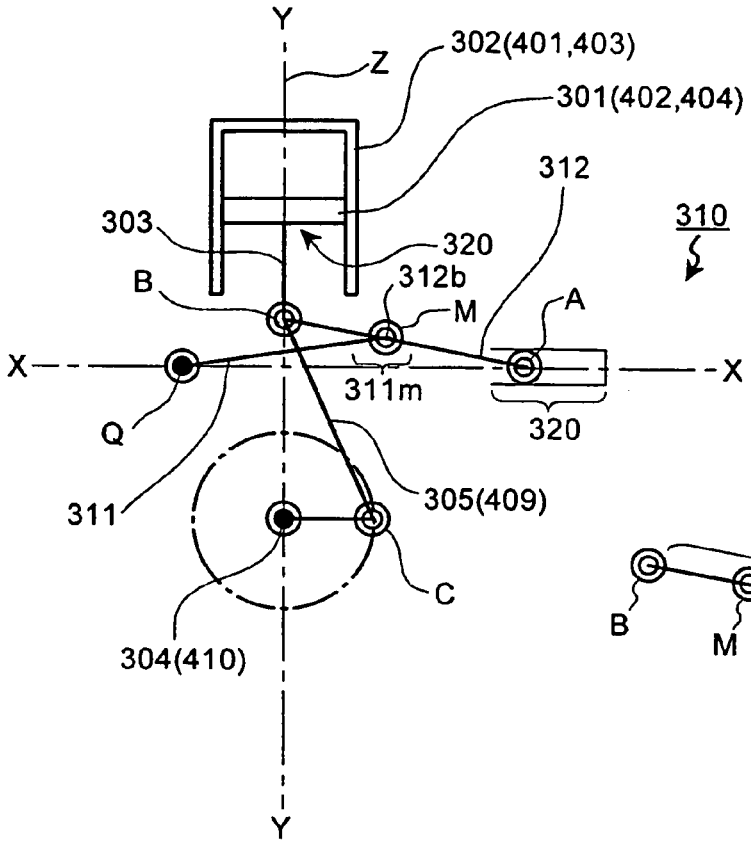
FIGS. 27A and 27B are schematic diagrams showing an linear approximation mechanism of the piston engine according to embodiment 2 of the present invention.
Figure 27B:
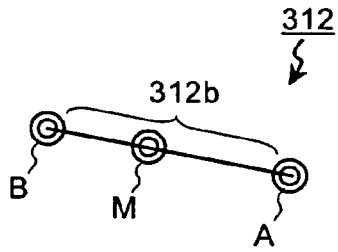
Figure 28:
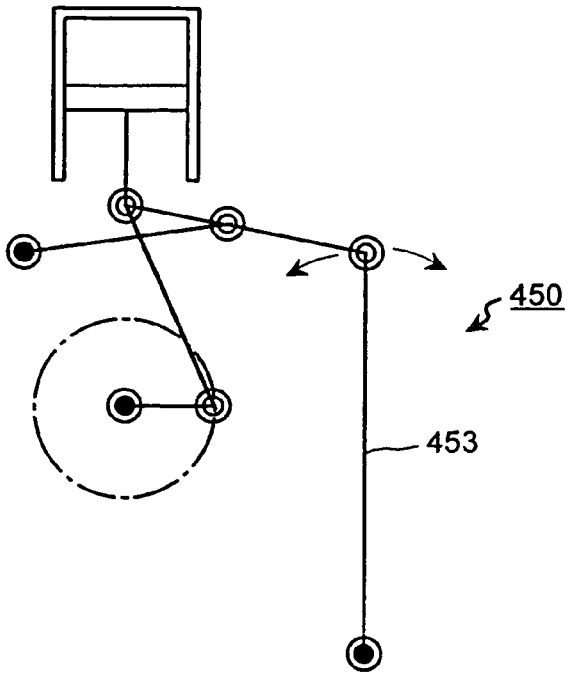
FIG. 28 is a schematic diagram showing a typical grasshopper mechanism.

FIGS. 27A and 27B are schematic diagrams showing the linear approximation mechanism of the stirling engine according to embodiment 2. FIG. 28 is a schematic diagram showing the grasshopper mechanism. In the following description, the coupling points indicated by black dots (for example, a supporting point Q) are coupling points, which rotate or rotationally move around their shaft but their positions relative to the cylinder 2 remain unchanged (hereinafter, such a coupling point is referred to as a "supporting point"). The coupling points indicated by white dots (for example, the second locomotive coupling point B) are coupling points, which rotate or rotationally move around their shaft and their position relative to the cylinder 2 change (hereinafter, such a coupling point is referred to as a "locomotive coupling point").

As shown in FIG. 27A, the linear approximation mechanism 310 is a linear approximation link mechanism using a grasshopper mechanism 450 (FIG. 28). More specifically, the linear approximation mechanism 310 supports the first locomotive coupling point A of the grasshopper mechanism 450 with a linearly moving guide 320 to cause the first locomotive coupling point A to make a linearly reciprocating motion according to the approximately linear motion of the second locomotive coupling point B. Accordingly, in the linear approximation mechanism 310 according to embodiment 2, the need for a longitudinal arm 453 (FIG. 28) necessary for the grasshopper mechanism 450 is eliminated. This enables the crankcase 418 of the stirling engine 400 to be further downsized. In particular, in the starling engine, which increases the pressure on the working fluid through pressurization of the crankcase 418, the larger crankcase 418 involves a significant increase in weight to ensure its pressure resistance.

On the contrary, according to embodiment 2, since the crankcase 418 may be downsized, increase in weight can be suppressed. In addition, since the need for the longitudinal arm 453 is eliminated, flexibility in design of the crankcase 418 is improved, whereby the crankcase 418 with a thinner wall though with a sufficient pressure resistance can be more easily designed. Moreover, flexibility in design of the stirling engine 400 is improved, whereby the stirling engine 400 can be designed according to a machine on which the stirling engine 400 is mounted.

As shown in FIG. 27A, the linear approximation mechanism 310 according to embodiment 2 is configured with a first lateral arm 311 and a second lateral arm 312. The first lateral arm 311 rotationally moves around the supporting point Q. The second lateral arm 312 has a third locomotive coupling point M connected to the first lateral arm 311 at a body 312*b*. The first lateral arm 311 is disposed so that it may intersect with the direction of the trajectory drawn by the approximately linear motion of the second locomotive coupling point B. An opposite end 311*m* of the supporting point Q on the first lateral arm 311 is rotatably coupled to the second lateral arm 312 at the third locomotive coupling point M.

Here, the supporting point Q is disposed at the point offset relative to the cylinder center axis Z and on the opposite side of the first locomotive coupling point A relative to the cylinder center axis Z. The first lateral arm 311 is disposed so that it may intersect with the connecting rod 305 coupling the piston 301 (high-temperature piston 402 or low-temperature piston 404) and the crankshaft 304. Note that the high-temperature piston 402 or the low-temperature piston 404 is referred to as the piston 301, if necessary, for the convenience of description.

Similar to the first lateral arm 311, the second lateral arm 312 is disposed so that the second lateral arm 312 may intersect with the direction of approximately linear motion of the second locomotive coupling point B. At one end of the second locomotive coupling point 312, the second locomotive coupling point B is disposed. The second locomotive coupling point B is coupled to the piston 301 by means of a piston coupling member 303. At the end of the second lateral arm 312 opposite to the second locomotive coupling point B, the first locomotive coupling point A is disposed.

The first locomotive coupling point A is reciprocally supported by means of the linearly moving guide 320. When the second locomotive coupling point B makes an approximately linear motion, the first locomotive coupling point A reciprocates on the linear line X-X shown in FIG. 27A along the linearly moving guide 320. Here, the linear line X-X intersects with the direction of the reciprocating motion of the piston 301 at a right angle. The third locomotive coupling point M is set so that the following equation may be met.

$$BM \times MQ = AM^2 \quad (1)$$

Here, BM indicates the distance between the second locomotive coupling point B and the third locomotive coupling point M, MQ indicates the distance between the third locomotive coupling point M and the supporting point Q, and AM indicates the distance between the first locomotive coupling point A and the third locomotive coupling point M.

The connecting rod 305 coupling the piston 301 and the crankshaft 304 is coupled to the second lateral arm 312 at the second locomotive coupling point B. This enables the reciprocating motion (the movement along the Z axis in the drawing) by the piston 301 to be transmitted to the crankshaft 304 by means of the piston coupling member 303, and the crankshaft 304 rotates around its rotational axis. Thus, the reciprocating motion by the piston 301 is converted into rotation by means of the crankshaft 304. Alternatively, the rotation of the crankshaft 304 may be converted into reciprocating motion by the piston 301.

Figure 29:
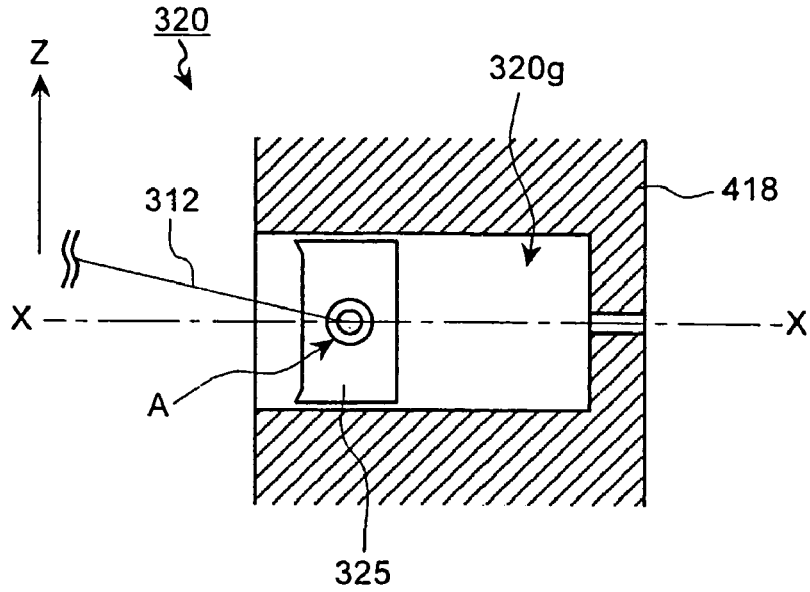
FIG. 29 is a schematic diagram showing a linearly moving guide of the linear approximation mechanism of the piston engine according to embodiment 2 of the present invention.
Figure 30:
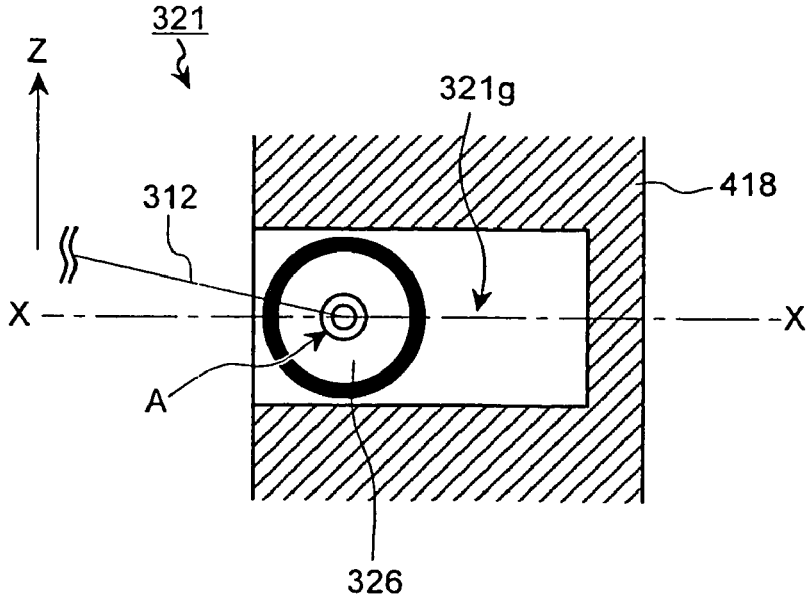
FIG. 30 is a schematic diagram showing the linearly moving guide of the linear approximation mechanism of the piston engine according to embodiment 2 of the present invention.

FIGS. 29 and 30 are schematic diagrams showing the linearly moving guide of the linear approximation mechanism of the stirling engine according to embodiment 2. As shown FIG. 29, the linearly moving guide 320 includes a cylindrical guide 320*g* and a slider piston 325 (linearly moving element) sliding inside the guide 320*g*. The slider piston 325 and the second lateral arm 312 are coupled to one another at the first locomotive coupling point A. When the slider piston 325 reciprocates inside the guide 320*g*, the first locomotive coupling point A makes linear motion inside the guide 320*g*. Thus, the slider piston 325 may be used as a compressor when the linearly moving element is configured with the slider piston 325. The use of the slider piston 325 as the compressor is described later. Note that the guide 320*g* is disposed inside the crankcase 418, which is a housing for the stirling engine 400.

A linearly moving guide 321 shown in FIG. 30 includes a guide 321*g* disposed inside the crankcase of the stirling engine 400 and a trank roller 326 (linearly moving element) rotationally moving inside the guide 321*g*. The trank roller 326 and the second lateral arm 312 are coupled to one another at the first locomotive coupling point A. When the trank roller 326 reciprocates inside the guide 321*g*, the first locomotive coupling point A makes linear motion inside the guide 321*g*. Thus, with the configuration of the linearly moving element with the trank roller 326, friction between the linearly moving element and the guide 321*g* may be reduced. Thus, frictional loss in the entire stirling engine 400 can be reduced, which is particular preferable when the energy is recovered from a low-temperature heat source. As aforementioned, since the first locomotive coupling point A reciprocates on the linear line X-X in the direction perpendicular to the direction of reciprocating motion of the piston 301 (the Z-axis direction in the figure), the guides 320*g*, 321*g* are disposed on the linear line X-X.

FIGS. 31 to 34 are schematic diagrams showing the movement of the linear approximation mechanism according to embodiment 2 during the piston strokes. In reference to the drawings, the operation of the linear approximation mechanism 310 according to embodiment 2 is described below. Note that though the linearly moving guide 321 using the trank roller 326 is used as the linearly moving guide, the linearly moving guide 320 using the slider piston 325 can similarly be used.

Figure 31:
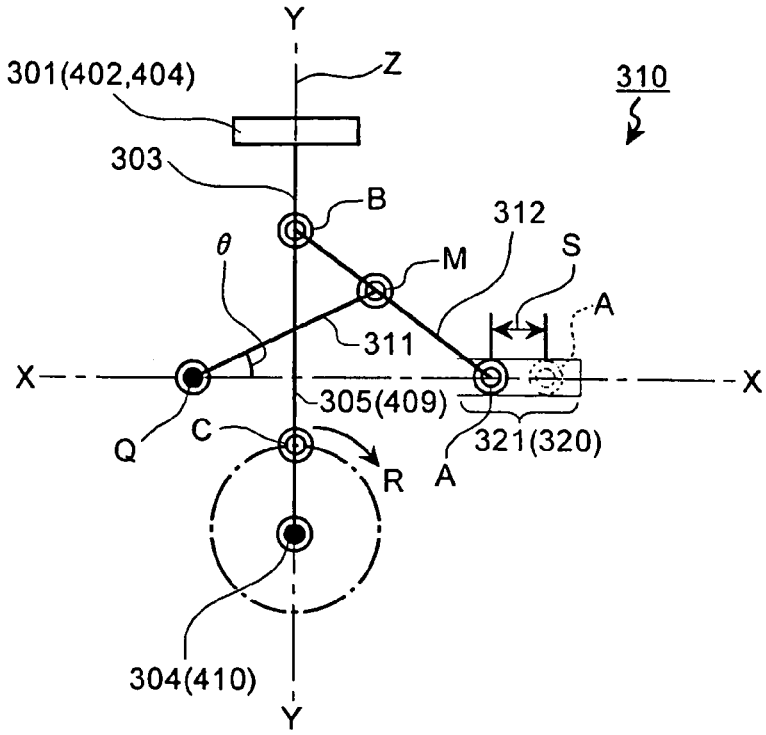
FIG. 31 is a schematic diagram showing displacement by the linear approximation mechanism of the piston engine as the piston strokes according to embodiment 2 of the present invention.

In the state shown in FIG. 31, i.e., when the piston 301 is at an upper dead point, the first locomotive coupling point A comes closest to the cylinder 2. When the piston 301 moves from the state shown in FIG. 31 toward the crankshaft 304, the crankshaft 304 rotates in the direction indicated by an arrow R shown in FIG. 31. Then, the second locomotive coupling point B moves toward the crankshaft 304 side, along which the second lateral arm 312 and the third locomotive coupling point M disposed at the second lateral arm 312 makes rotational motion toward the crankshaft 304 around the first locomotive coupling point A. When the third locomotive coupling point M makes rotational motion toward the crankshaft 304 around the first locomotive coupling point A, the first lateral arm 311 makes rotational motion toward the crankshaft 304 around the supporting point Q.

Figure 32:
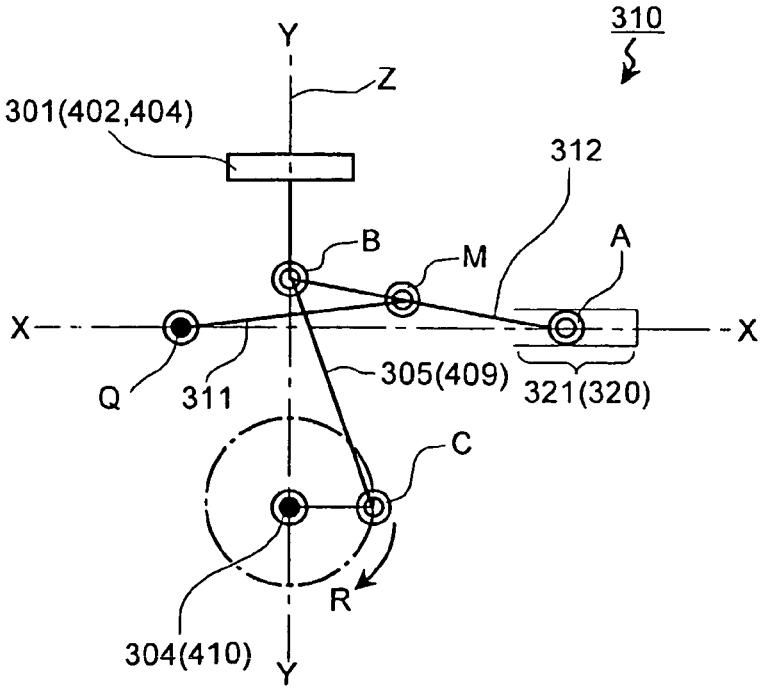
FIG. 32 is a schematic diagram showing the displacement by the linear approximation mechanism of the piston engine as the piston strokes according to embodiment 2 of the present invention.
Figure 33:
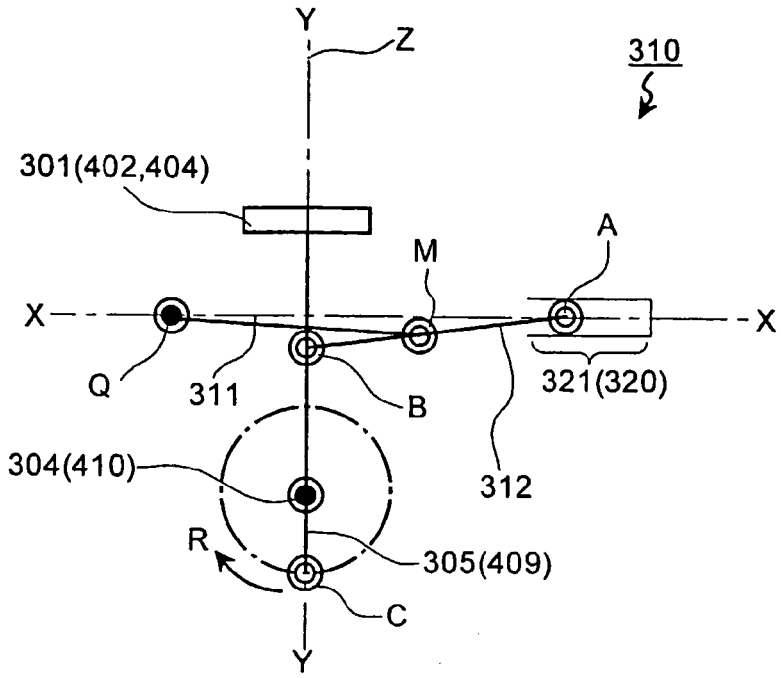
FIG. 33 is a schematic diagram showing the displacement by the linear approximation mechanism of the piston engine as the piston strokes according to embodiment 2 of the present invention.
Figure 34:
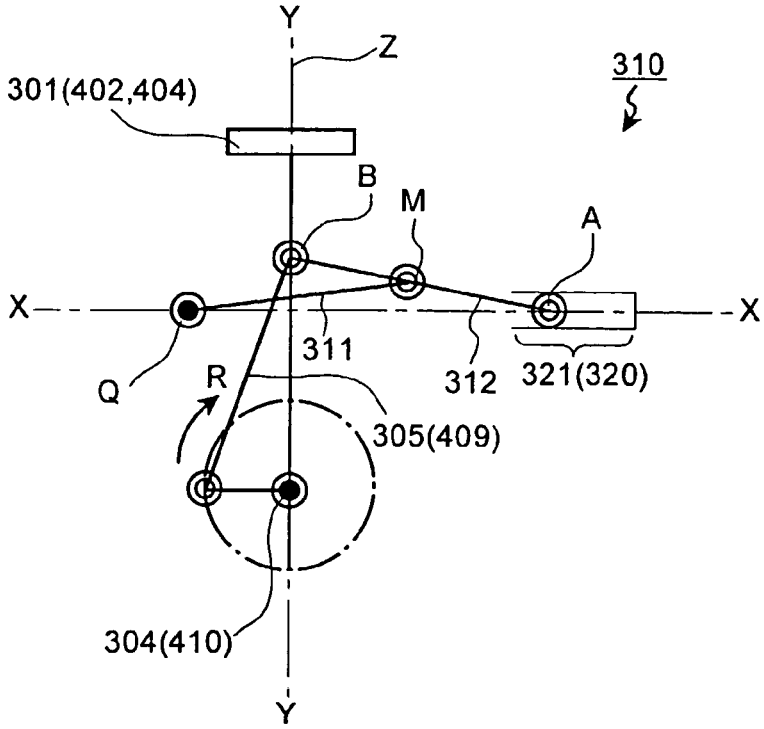
FIG. 34 is a schematic diagram showing the displacement by the linear approximation mechanism of the piston engine as the piston strokes according to embodiment 2 of the present invention.

Then, the first locomotive coupling point A moves inside the linearly moving guide 320 away from the cylinder 302 (FIG. 32). When the piston 301 comes to the lower dead point, the linear approximation mechanism 310 takes a shape shown in FIG. 33. As the piston 301 approaches the lower dead point, the first locomotive coupling point A moves inside the linearly moving guide 320 toward the cylinder 302. In the process where the piston 301 passes the lower dead point and approaches the upper dead point again, the first locomotive coupling point A moves inside the linearly moving guide 320 away from the cylinder 302 (FIG. 34).

The first lateral arm 311 makes rotational motion around the supporting point Q. The third locomotive coupling point M disposed at the end of the first lateral arm 311 opposite to the supporting point Q makes rotational motion around the supporting point Q in the coverage where the second locomotive coupling point B moves, i.e., in the coverage where the piston 301 reciprocates between the upper and lower dead points. Accordingly, the first locomotive coupling point A comes closest to the cylinder 302 at least at one of upper and lower dead points depending on an angle θ defined between the linear line X-X and the first lateral arm 311 when the piston 301 stays at the upper dead point. When the first locomotive coupling point A, the second locomotive coupling point B, and the third locomotive coupling point M are positioned on the linear line X-X, the first locomotive coupling point A gets farthest away from the cylinder 302. Thus, the first locomotive coupling point A reciprocates on the linear line X-X in step S (FIG. 31).

In this configuration, the second locomotive coupling point B of the linear approximation mechanism 310 according to embodiment 2 reciprocates on an approximately linear line substantially along the central axis Z of the cylinder. Thus, the piston 301 also reciprocates in the same manner. Consequently, since the side force (the force towards the radial direction of the piston 301) exerted on the piston 301 may be reduced substantially to zero (0), the piston may be well supported even by the small air bearing 412 with low loading capacity as in the stirling engine 400 described above.

The deviation of the piston 301 from the linear line Y-Y (the central axis Z of the cylinder) in the vicinity of the upper dead point is preferably set to a value smaller than the deviation of the piston 301 from the linear line Y-Y in the vicinity of the lower dead point. It is because in the stirling engine 400, when the piston 301 (the high-temperature piston 402 and the like) comes to vicinity of the upper dead point, the pressure of the working fluid exerted on the piston 301 becomes larger. Accordingly, if the deviation of the piston 301 is small at the upper dead point, the side force F exerted on the piston 301 is reduced, decreasing the friction between the piston 301 and the cylinder 302. On the other hand, when the piston 301 stays in the vicinity of the lower dead point, the pressure of the working fluid exerted on the piston 301 becomes smaller. Hence, even if the deviation of the piston 301 at the lower dead point is relatively large, it has less effect on the friction between the piston 301 and the cylinder 302. Note that the deviations δlt and δlu may be adjusted depending on the lengths of the first and second lateral arms 311, 312, and the position of the third locomotive coupling point M.

Figure 35:
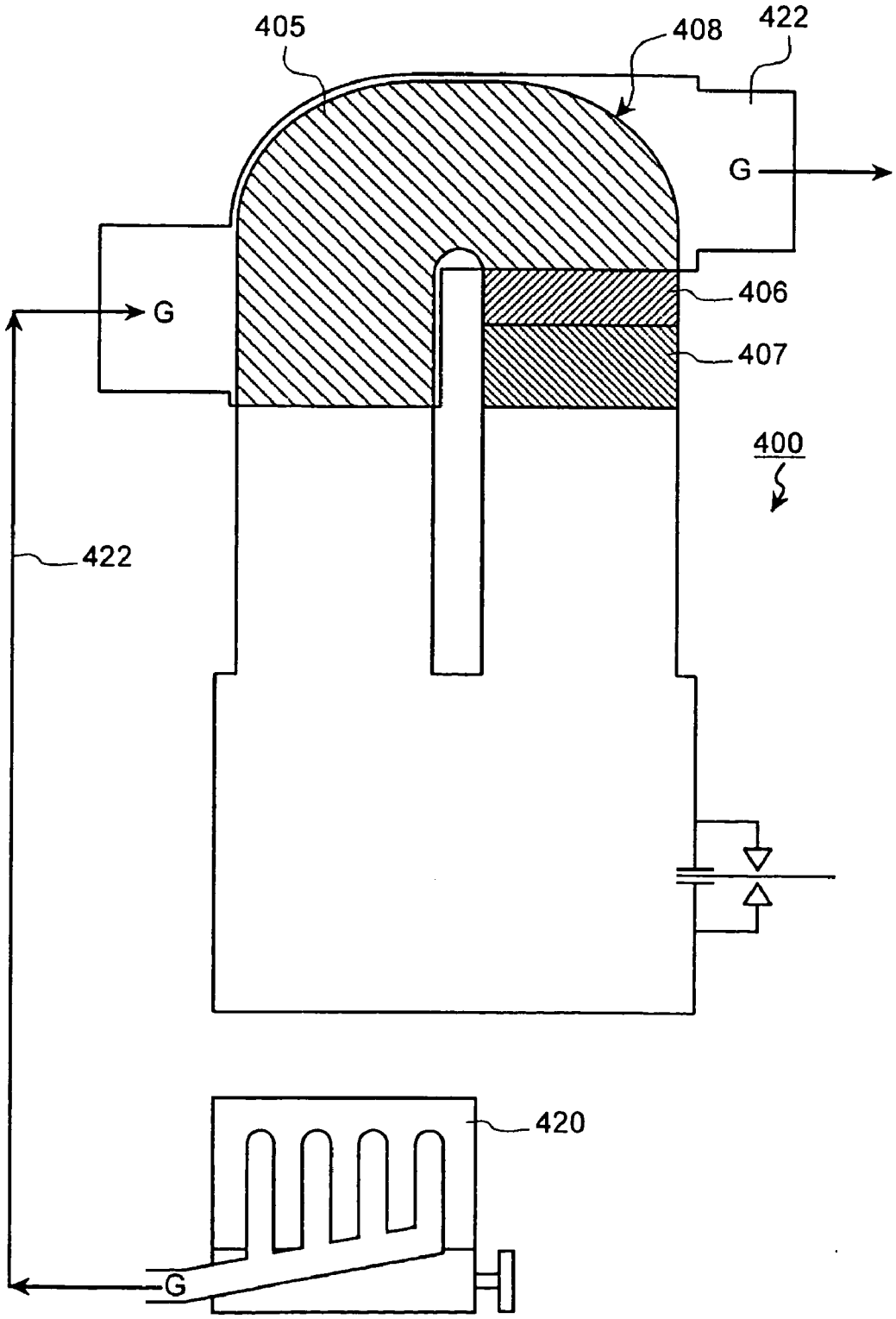
FIG. 35 is a schematic diagram showing an example of the mounted piston engine according to embodiment 2 of the present invention.

FIG. 35 is a schematic diagram showing an example of a manner of mounting the piston engine according to embodiment 2. In the example, the stirling engine 400, which is the piston engine according to embodiment 2 is employed for the recovery of exhaust heat from the internal combustion engine. As shown in FIG. 35, at least the heater 405 of the heat exchanger 408 of the stirling engine 400 is disposed inside an exhaust pathway 422 of the internal combustion engine 420, for example, a gasoline engine or a diesel engine. This configuration allows for the recovery of exhaust heat of exhaust gas G in the internal combustion engine 420 by the stirling engine 400.

As is clear from the foregoing, according to embodiment 2, since the longitudinal arm of the grasshopper which serves as the linear approximation mechanism is not necessary, the casing of the piston engine which houses the linear approximation mechanism can be made compact. As a result, the entire piston engine can be made more compact and the increase in weight of the piston engine can be suppressed. In particular, when the piston engine increases the pressure applied to the working fluid through the pressurization of the crankcase, since the crankcase may be downsized, increase in weight involved in ensuring the pressure resistance may be suppressed. In addition, since the longitudinal arm is not necessary, flexibility in crankcase design is increased, whereby a crankcase with a thin wall can be more readily designed while sufficient pressure resistance is secured. Still in addition, in turn, since the flexibility in design of the piston engine is increased, the piston engine can be more readily designed according to a machine on which the piston engine is to be mounted. When the piston engine is used to recover exhaust heat from the internal combustion engine, many restrictions are usually imposed in terms of a position of mounting. According to embodiment 2, however, flexibility in arrangement is increased.

Embodiment 3

A piston engine according to embodiment 3 has approximately the same configuration as that of the piston engine according to embodiment 2 with such exceptions that: the linearly moving guide includes a cylindrical guide and a slide piston sliding inside the cylindrical guide; the first locomotive coupling point is kept in the condition where it may make linear motion; and a compressor is configured by means of the cylindrical guide and the piston. Since other mechanisms are the same as those according to embodiment 2, the descriptions thereof are omitted and the same symbols are assigned to the same components.

Figure 36:
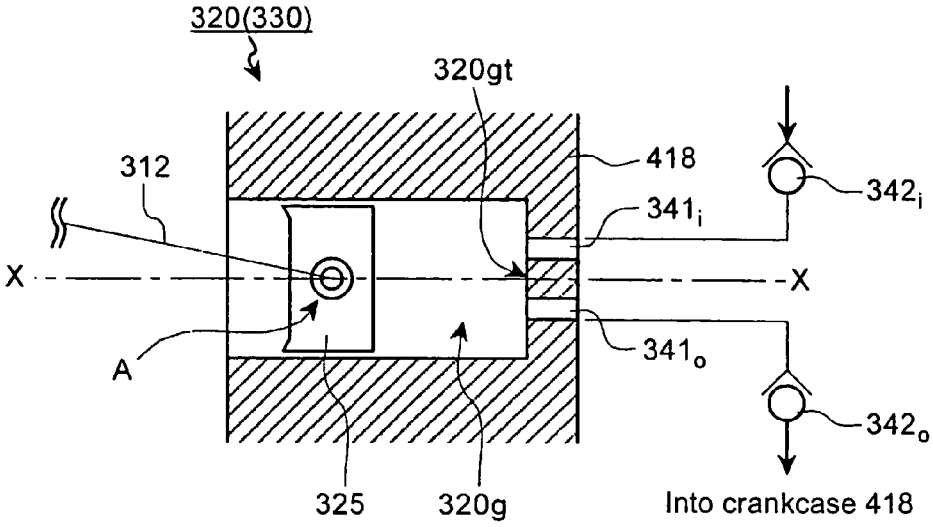
FIG. 36 is a sectional view showing a piston engine according to embodiment 3 of the present invention.
Figure 37:
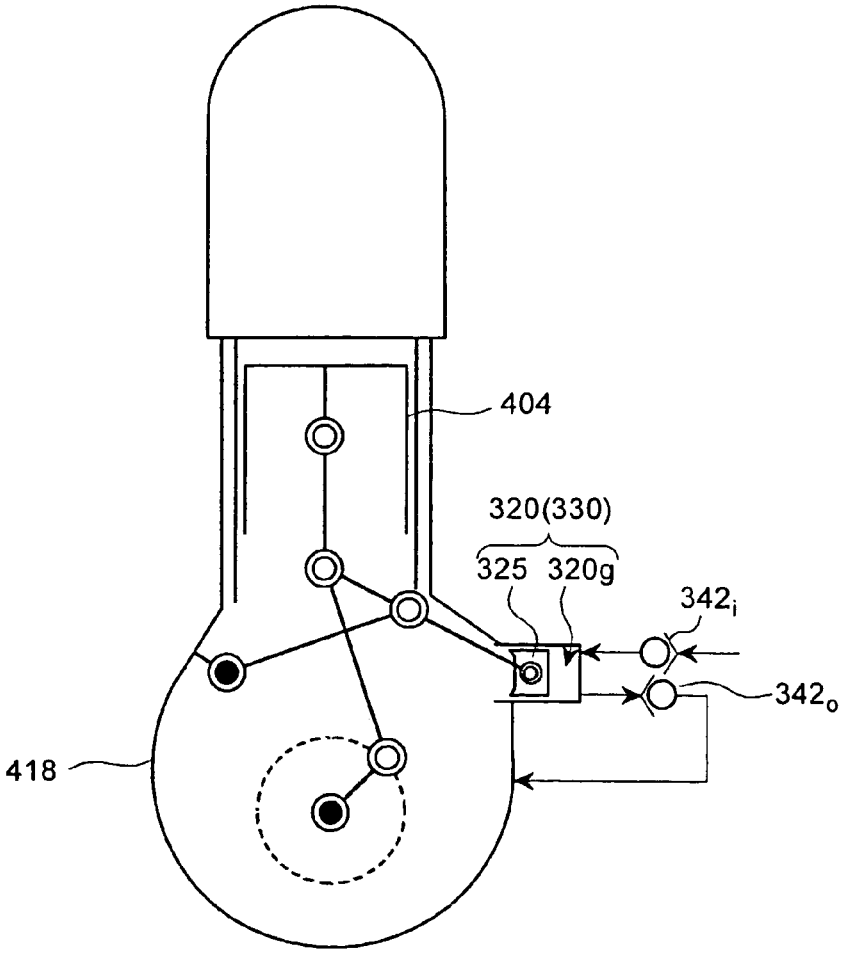
FIG. 37 is a sectional view showing the piston engine according to embodiment 3 of the present invention.

FIGS. 36, 37 are sectional views showing the piston engine according to embodiment 3. Herein, a compressor 330 is disposed on the low-temperature piston 404 side of the stirling engine 400, which is a piston engine. As shown in FIG. 7, the stirling engine 400 uses the linearly moving guide 320 of the linear approximation mechanism 310 disposed at the low-temperature piston 404 as the compressor 330.

The linearly moving guide 320 includes a cylindrical guide 320*g* and a slider piston 325 (linearly moving element) sliding inside the cylindrical guide 320*g*. The slider piston 325 and a second lateral arm 312 are coupled to one another at the first locomotive coupling point A. As the stirling engine 400, which is a piston engine, runs, the high-temperature piston 402 starts to reciprocate and the slider piston 325 reciprocates inside the cylindrical guide 320*g*. Accordingly, a gas (herein, air) introduced between the cylindrical guide 320*g* and the slider piston 325 is discharged from an exhaust port 341*o* formed at a top 320*gt* of the cylindrical guide 320*g*.

To bring out its performance as the compressor 330, at the top 320*gt* of the cylindrical guide 320*g*, an admission port 341*i* and the exhaust port 341*o* are formed, to which an admission check valve 342*i* and an exhaust check valve 342*o* are attached, respectively. The admission check valve 342*i* blocks a gas flow running out from the cylindrical guide 320*g* into the outer space, while the exhaust check valve 342*o* blocks the gas flow running into the cylindrical guide 320*g*. In this configuration, the slider piston 325 sucks the gas into the cylindrical guide 320*g* from the admission port 341*i* when the slider piston 325 moves to the opposite side of the top 320*gt* of the guide 320*g*, whereas the slider piston 325 discharges the sucked gas through the exhaust port 341*o* when it moves to the side of the top 320*gt*. This enables the linearly moving guide 320 to serve as the compressor 330. Note that to bring out the performance of linearly moving guide 320 as the compressor 330, a sealing member is preferably disposed between the outer surface of the slider piston 325 and the inner surface of the guide 320*g* in a range of acceptable sliding resistance.

As aforementioned, in the stirling engine 400 according to embodiment 3, the linearly moving guide 320, which serves as the compressor 330, of the first locomotive coupling point may be used as an auxiliary machinery of the stirling engine 400. In the case of the stirling engine 400, in particular, the inside of the crankcase 418 is pressurized to increase the pressure applied to the working fluid. In this case, as shown in FIG. 37, with the introduction of the gas discharged from the exhaust port 341*o* into the crankcase 418, the linearly moving guide 320 may be used as a crankcase pressurizing means. Since this eliminates the need for a separate compressor as the crankcase pressurizing means (a working fluid pressurizing means), the manufacturing cost of the stirling engine 400 may be reduced.

Figure 38:
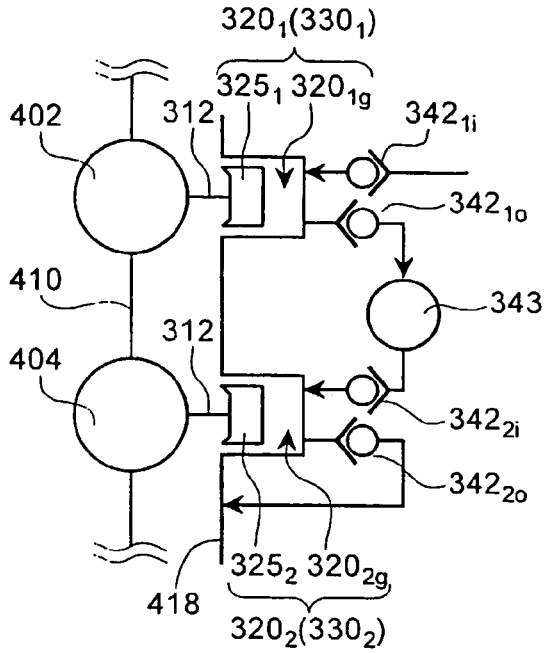
FIG. 38 is a schematic diagram showing a first modification of the piston engine according to embodiment 3 of the present invention.
Figure 39:
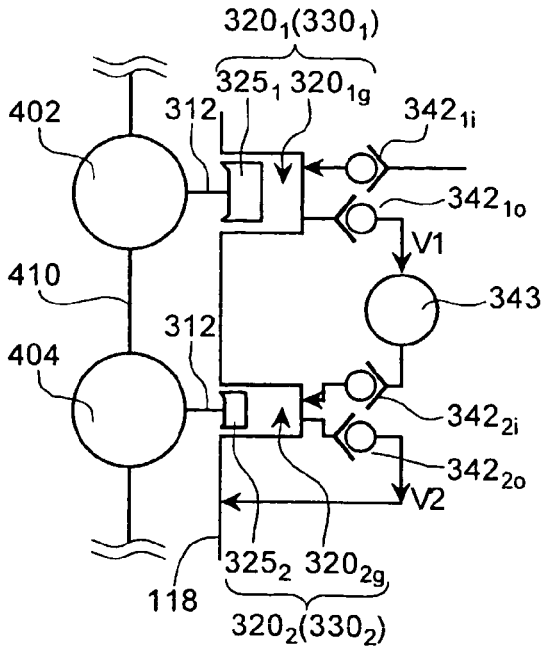
FIG. 39 is another schematic diagram showing the first modification of the piston engine according to embodiment 3 of the present invention.

FIGS. 38, 39 are schematic diagrams showing a first modification of embodiment 3. The stirling engine 400 according to the first modification has approximately the same configuration as that of the piston engine according to embodiment 2 with such exceptions that the compressor is disposed at each of the high-temperature piston 402 and the low-temperature piston 404 and these are connected in line to compress the gas in a plurality of steps. Since other mechanisms are the same as those according to embodiment 2, the descriptions thereof are omitted and the same symbols are assigned to the same components. Note that in the stirling engine with three or more cylinder piston sets, three or more compressors may be provided.

Each of the high-temperature piston 402 and the low-temperature piston 404 has a first linearly moving guide $\mathbf{320}_1$ and a second linearly moving guide $\mathbf{320}_2$, which serve as a first compressor $\mathbf{330}_1$ and a second compressor $\mathbf{330}_2$, respectively. A first admission check valve $\mathbf{342}_{1i}$ and a first exhaust check valve $\mathbf{342}_{1o}$ are disposed at a guide $\mathbf{320}_{1g}$ of the first compressor $\mathbf{330}_1$. A second admission check valve $\mathbf{342}_{2i}$ and a second exhaust check valve $\mathbf{342}_{2o}$ are disposed at a guide $\mathbf{320}_{2g}$ of the second compressor $\mathbf{330}_2$.

The gas compressed at the first compressor $\mathbf{330}_1$ is transported to an accumulator 343 via the first exhaust check valve $\mathbf{342}_{1o}$ and then to the second compressor $\mathbf{330}_2$ from the accumulator via the second admission check valve $\mathbf{342}_{2i}$. The gas, further compressed at the second compressor $\mathbf{330}_2$, is transported to the inside of the crankcase 418 via the second exhaust check valve $\mathbf{342}_{2o}$ to pressurize the inside of the crankcase. Thus, the first compressor $\mathbf{330}_1$ and the second compressor $\mathbf{330}_2$ connected in line compress the gas in a plurality of steps.

The gas compressed at the first compressor $\mathbf{330}_1$ is stored in the accumulator 343 and then transported to the second compressor $\mathbf{330}_2$. The gas further compressed at the second compressor $\mathbf{330}_2$ is transported to the inside of the crankcase 418. Thus, since the gas is compressed in a plurality of steps (herein, in two steps), the gas may be pressurized up to a higher level than that by the single compressor. Moreover, since the efficiency in serving as the compressor may be optimized, compression efficiency may also be improved. As shown in FIG. 39, in the case where the gas is compressed in a plurality of steps, a discharge V1 (volume) from the first compressor $\mathbf{330}_1$ in a former step may be set to a larger value than that for a discharge V2 (volume) from the second compressor $\mathbf{330}_2$ in a latter step. This enables the gas to be efficiently compressed up to a higher level.

Figure 40:
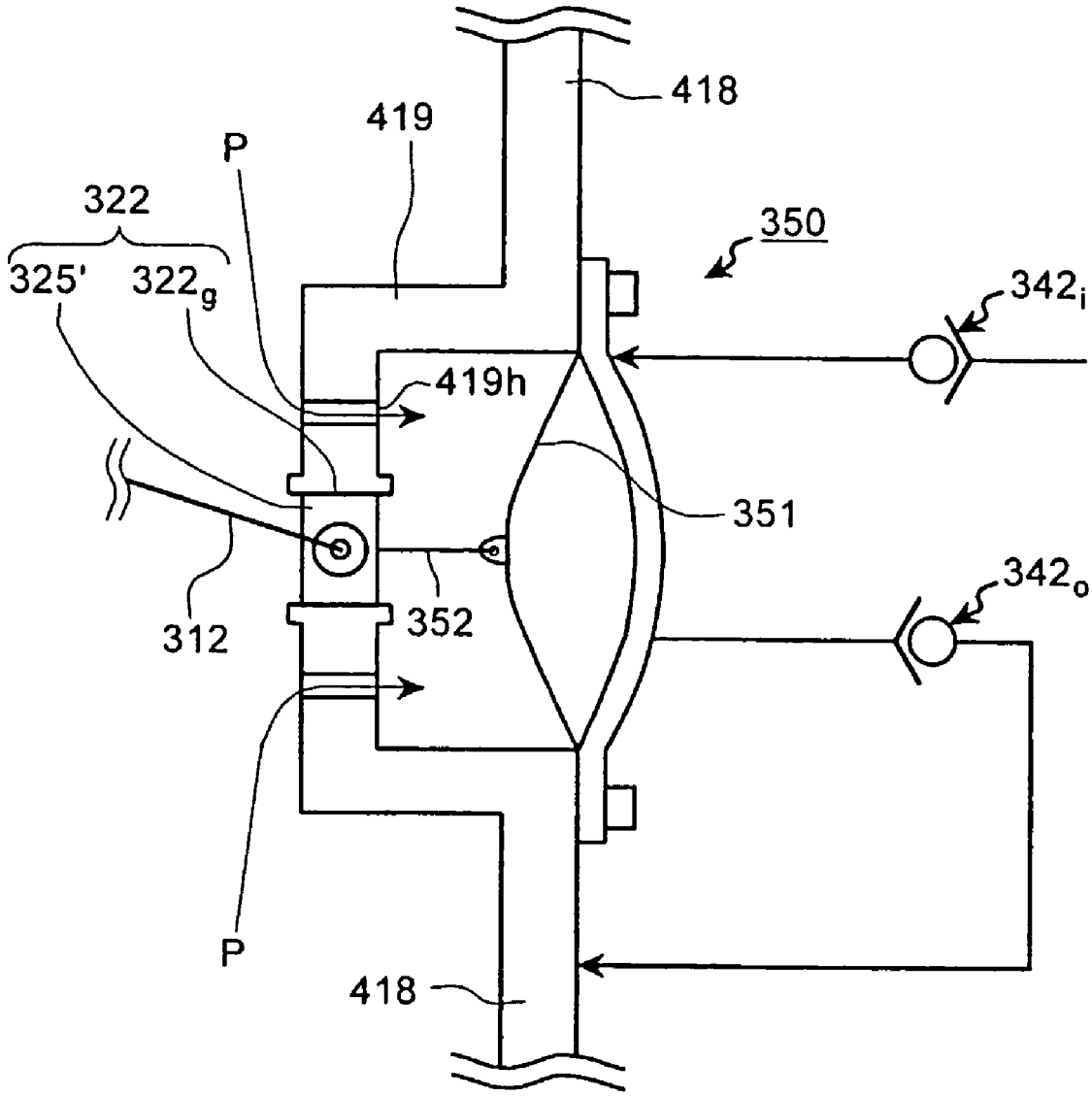
FIG. 40 is a schematic diagram showing a second modification of the piston engine according to embodiment 3 of the present invention.
Figure 41:
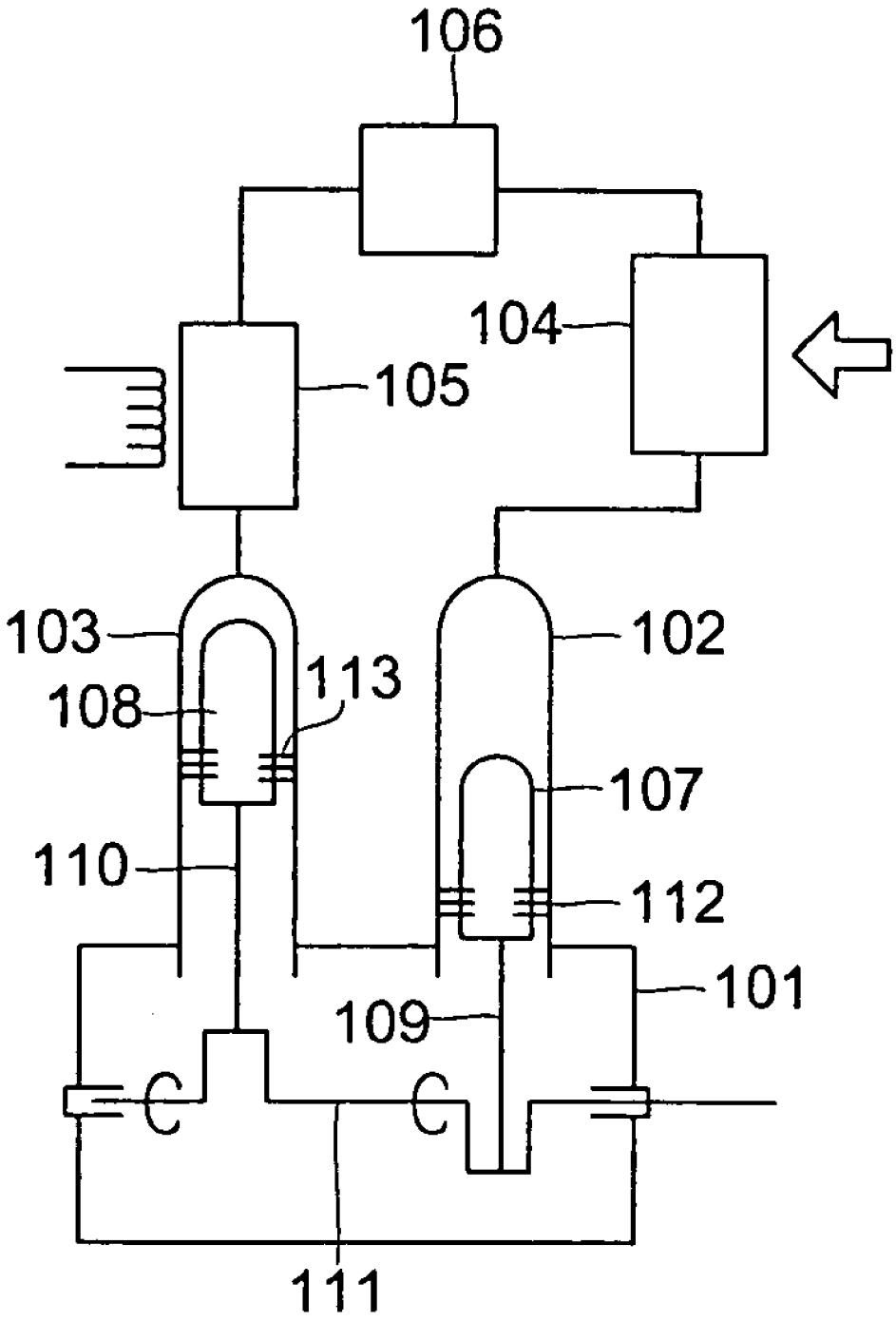
FIG. 41 is a partial sectional side view showing an example of a configuration of a conventional stirling engine.

FIG. 40 is a schematic diagram showing a second modification of embodiment 3. For a compressor of the stirling engine, a diaphragm 350 is used. The linearly moving guide 322 is formed on a diaphragm base 419 disposed at the crankcase 418. The linearly moving guide 322 has a slider piston 325' and a supporting element 322*g* which slidably supports the slider piston 325'. The slider piston 325' and a diaphragm plate 351 are coupled to one another by means of a coupling element 352. The diaphragm base 419 is configured so that a pressure P inside the crankcase 418 may act on the rear side of the diaphragm plate 351 by means of a communicating orifice 419*h*. The slider piston 325' reciprocates according to the reciprocating motion of the high-temperature piston 402 and the like, thereby causing the diaphragm plate 351 to reciprocate to discharge the gas from the diaphragm 350. Here, the diaphragm, as well as bellows, may be used as the compressor.

As aforementioned, according to embodiment 3, the linearly moving guide of the first locomotive coupling point, which serves as the compressor, may be used as an auxiliary machinery of the piston engine. Since this eliminates the need for a separate auxiliary machinery, not only the manufacturing cost of the piston engine but also the total cost of manufacturing the whole apparatus on which the piston engine is mounted may be reduced. In the case of the piston engine, in particular, in which the working fluid is pressurized, the working fluid may be pressurized by means of the compressor. This eliminates the need for the separate compressor as a pressurizing means, saving the manufacturing cost of the piston engine.

In embodiments 2 and 3 and their modifications, the following items are disclosed.

To attain the aforementioned objects, the piston engine according to the embodiment is a piston engine, wherein the piston reciprocating inside the cylinder and the rotationally moving crankshaft are coupled to one another by means of the connecting rod, having; a first lateral arm, which intersects with the connecting rod and is rotatable around a supporting point placed between the piston and the crankshaft, at a position offset relative to the central axis of the cylinder; a second lateral arm, which has a first locomotive coupling point linearly reciprocating and a second locomotive coupling point coupled to the piston at respective ends and a third locomotive coupling point, to which an end of the first lateral arm opposite to the supporting point is rotatably coupled, between the first locomotive coupling point and the second locomotive coupling point; and a linearly moving guide, which supports the first locomotive coupling point to make linear motion.

The piston engine according to the configuration aforementioned eliminates the need for the longitudinal arm necessary for the grasshopper mechanism, which is the linear approximation mechanism, enabling the piston engine case, which accommodates the linear approximation mechanism, to be downsized. Consequently, the entire piston engine may be downsized and an increase in weight of the piston engine may be suppressed.

The piston engine according to the embodiment is characterized in that the linearly moving guide includes a cylindrical guide and a slider piston sliding inside the guide, and the linearly moving guide is a compressor, which compresses a gas inside the guide by means of the reciprocating motion by the slider piston.

The piston engine allows the linearly moving guide, which causes the first locomotive coupling point of the second lateral arm to linearly reciprocate, to serve as a compressor. This allows for a downsizing of the piston engine and further the linearly moving guide may be used as an auxiliary machinery of the piston engine.

The piston engine according to the embodiment is characterized in that in the case where it has a plurality of pistons, a plurality of compressors are configured, and each compressor is connected in line to increase the pressure applied to a gas in steps.

Since the piston engine compresses the gas in a plurality of steps by connecting a plurality of linearly moving guides in line to use the same as the compressor, it may increase the pressure applied to the gas up to the higher level than that achievable by a single compressor.

The piston engine according to the embodiment is characterized in that a discharge from the subsequent compressor is smaller than that from the previous compressor.

This configuration enables the gas to be efficiently compressed up to the higher level.

The piston engine according to the embodiment, which is a stirling engine, is characterized in that the working fluid fed from a heat exchanger having a heater, a regenerator, and a cooler is introduced into the inside of the cylinder to drive the piston.

According to embodiment 3, since the need for the longitudinal arm necessary for the grasshopper mechanism, which is the linear approximation mechanism, is eliminated, the overall size of the case and the stirling engine may be reduced and an increase in total weight of the stirling engine may be suppressed. In the case of the stirling engine, in particular, in which the working fluid is pressurized, the case may be downsized to suppress an increase in weight involved in ensuring the pressure resistance.

The piston engine according to the embodiment is characterized in that it has at least a housing enclosing the crankshaft inside and the compressor pressurizes the inside of the housing.

This eliminates the need for the separate compressor as the means for pressurizing the fluid, saving the manufacturing cost of the piston engine.

The piston engine according to the embodiment is characterized in that at least the heater of the heat exchanger is disposed on the exhaust pathway of the internal combustion engine to recover heat exhausted from the internal combustion engine.

In the piston engine according to the embodiment, the case or the entire piston engine may be downsized. Accordingly, if it is used to recover exhaust heat of the internal combustion engine, flexibility in arrangement is increased. Moreover, since an increase in total weight of the entire piston engine may be suppressed, when the piston engine is used to recover heat exhausted from the internal combustion engine mounted on vehicles such as automobiles and buses, an increase in total weight of the vehicle may also be suppressed.

INDUSTRIAL APPLICABILITY

As aforementioned, the stirling engine of the present invention can make use of various types of alternative energy such as exhaust heat, contributing to energy saving. In particular, the stirling engine of the present invention is suitable for the use under the rigorous environment where it is difficult to reserve ample heat from a heat source as in the case where the gas exhausted from the internal combustion engine of a vehicle is used as a heat source.

The invention claimed is:

1. A stirling engine comprising;

a cylinder, a piston reciprocating inside the cylinder while keeping an air-tight condition between the piston and the cylinder by means of a gas bearing, and a linear approximation mechanism coupled directly or indirectly to the piston to make an approximately linear motion when the piston reciprocates inside the cylinder, wherein an exhaust system of an internal combustion engine provides a heat source for the stirling engine, and the gas bearing supports the piston without contact by means of pressure of distributed gas.

2. The stirling engine according to claim 1, further comprising;

a crankshaft rotating around an output shaft;

an extension extending downward from the piston; and a connecting rod coupling the extension and the crankshaft, wherein the linear approximation mechanism is coupled to a coupling element between the extension and the connecting rod to control movement of the coupling element so that the coupling element makes an approximately linear motion along an axial centerline of the cylinder.

3. The stirling engine according to claim 2, wherein the piston and the extension are rotatably connected to one another.

4. The stirling engine according to claim 2, wherein the linear approximation mechanism is configured so that a first deviation of the coupling element from the axial centerline of the cylinder at an upper dead point of the piston is smaller than a second deviation of the coupling element from the axial centerline of the cylinder at a lower dead point of the piston.

5. The stirling engine according to claim 1, wherein the linear approximation mechanism is a grasshopper mechanism.

6. The stirling engine according to claim 2, wherein the linear approximation mechanism is a grasshopper mechanism, the grasshopper mechanism includes, first and second lateral links, and a longitudinal link, wherein a first end of the first lateral link is rotatably coupled to the coupling element between the extension and the connecting rod, a second end of the fist lateral link is rotatably coupled to a first end of the longitudinal link, a second end of the longitudinal link is rotatably fixed to a predetermined position of the stirling engine, a first end of the second lateral link is rotatably coupled to the first lateral link at a predetermined position in the middle of the first lateral link, and a second end of the second lateral link is rotatably fixed to the stirling engine at a predetermined position.

7. The stirling engine according to claim 6, wherein in the grasshopper mechanism, the first end of the second lateral link has a two-forked structure having two fork ends, and the first end of the first lateral link is configured to pass between the fork ends.

8. The stirling engine according to claim 6, wherein in the grasshopper mechanism, the first end of the first lateral link and the coupling element between the extension and the connecting rod are coupled by means of a single piston pin.

9. The stirling engine according to claim 6, wherein in the grasshopper mechanism, among the first end of the first lateral link, an end of the extension at the coupling element between the extension and the connecting rod, and an end of the connecting rod, two ends have a two-forked structure having two fork ends, and the end of the remaining one of the three ends is disposed between the two fork ends of two other ends.

10. The stirling engine according to claim 1, further comprising:

a crankshaft which rotates; and a connecting rod coupling the crankshaft and the piston, wherein the linear approximation mechanism has a first lateral arm, a second lateral arm, and a linearly moving guide, wherein the first lateral arm is disposed so that the first lateral arm intersects with the connecting rod and is rotatable around a supporting point placed between the piston and the crankshaft, at a position offset relative to an axial centerline of the cylinder, and the second lateral arm has first and second ends, wherein at the first end, a first locomotive coupling point which linearly reciprocates is placed, and at the second end, a second locomotive coupling point which is coupled to the piston is placed, between the first locomotive coupling point and the second locomotive coupling point, a third locomotive coupling point is placed, at the third locomotive coupling point, an end of the first lateral arm opposite to the supporting point is rotatably coupled, and the linearly moving guide supports the first locomotive coupling point and guides the first locomotive coupling point as to make a linear motion.

11. The stirling engine according to claim 10, wherein the linearly moving guide comprises a cylindrical guide and a slider piston that slides inside the cylindrical guide, and the linearly moving guide has a function of serving as a compressor that compresses the gas inside the cylindrical guide by means of the reciprocating motion by the slider piston inside the cylindrical guide.

12. The stirling engine according to claim 11, further comprising:

a plurality of the pistons and a plurality of the linear approximation mechanisms disposed corresponding to the plurality of the pistons, respectively, wherein a plurality of the compressors are provided corresponding to the plurality of the linear approximation mechanisms, respectively, and the compressors are connected in line so that the compressors increase the pressure applied to the gas in steps.

13. The stirling engine according to claim 12, wherein a discharge from the subsequent compressor is smaller than a discharge from the previous compressor.

14. The stirling engine according to claim 10, further comprising a housing disposed with at least the crankshaft enclosed inside, wherein the inside of the housing is pressurized by means of the compressor.

15. A hybrid system comprising:

the stirling engine according to claim 1, and an internal combustion engine of a vehicle, wherein the stirling engine is mounted on the vehicle and, a heater of the stirling engine is arranged to draw heat from an exhaust system of the internal combustion engine.

16. A piston engine, comprising:

a cylinder;

a piston reciprocating inside the cylinder while keeping an air-tight condition between the cylinder and the piston by means of a gas bearing;

a rotatable crankshaft;

a connecting rod coupling the crankshaft and the piston; and a linear approximation mechanism coupled directly or indirectly to the piston and disposed so that the piston makes approximately linear motion when the piston reciprocates inside the cylinder.

17. A piston engine, comprising:

a cylinder;

a piston reciprocating inside the cylinder while keeping an air-tight condition between the piston and the cylinder by means of a gas bearing;

a rotatable crankshaft;

a connecting rod coupling the crankshaft and the piston;

a first lateral arm;

a second lateral arm; and a linearly moving guide, wherein the first lateral arm is disposed so that the first lateral arm intersects with the connecting rod and make rotational motion around a supporting point placed between the piston and the crankshaft and at a position offset relative to an axial centerline of the cylinder, the second lateral arm has first and second ends, at the first end, a first locomotive coupling point that linearly reciprocates is placed, at the second end, a second locomotive coupling point is coupled to the piston, between the first locomotive coupling point and the second locomotive coupling point, a third locomotive coupling point is placed, at the third locomotive coupling point, an end of the first lateral arm opposite to the supporting point is rotatably coupled, and the linearly moving guide supports the first locomotive coupling point and guides the first locomotive coupling point so that the first locomotive coupling point makes linear motion.

18. The piston engine according to claim 16, wherein the piston engine is a stirling engine and working fluid fed from a heat exchanger having a heater, a regenerator, and a cooler is introduced into the cylinder to drive the piston.

19. The piston engine according to claim 18, wherein at least the heater of the heat exchanger is disposed on an exhaust pathway of the internal combustion engine to recover heat exhausted from the internal combustion engine.

20. The piston engine according to claim 16, wherein the linearly moving guide has a cylindrical guide and a slider piston sliding inside the cylindrical guide, and the linearly moving guide has a function as a compressor which compresses a gas inside the cylindrical guide by means of reciprocating motion by the slider piston inside the cylindrical guide.

21. The piston engine according to claim 17, wherein the piston engine is a stirling engine and working fluid fed from a heat exchanger having a heater, a regenerator, and a cooler is introduced into the cylinder to drive the piston.

22. The piston engine according to claim 21, wherein at least the heater of the heat exchanger is disposed on an exhaust pathway of the internal combustion engine to recover heat exhausted from the internal combustion engine.

* * * * *